US011174760B2

(12) United States Patent
Fischer et al.

(10) Patent No.: US 11,174,760 B2
(45) Date of Patent: Nov. 16, 2021

(54) CAMSHAFT PHASER

(71) Applicant: DELPHI TECHNOLOGIES IP LIMITED, St. Michael (BB)

(72) Inventors: Thomas H. Fischer, Rochester, NY (US); Prashant Bhokardole, Bangalore (IN)

(73) Assignee: DELPHI TECHNOLOGIES IP LIMITED

( * ) Notice: Subject to any disclaimer, the term of this patent is extended or adjusted under 35 U.S.C. 154(b) by 136 days.

(21) Appl. No.: 16/216,593

(22) Filed: Dec. 11, 2018

(65) Prior Publication Data

US 2020/0182104 A1 Jun. 11, 2020

(51) Int. Cl.
*F01L 1/344* (2006.01)

(52) U.S. Cl.
CPC ..... *F01L 1/3442* (2013.01); *F01L 1/34409* (2013.01); *F01L 2001/3443* (2013.01); *F01L 2001/34469* (2013.01)

(58) Field of Classification Search
CPC ..... F01L 1/3442; F01L 1/344; F01L 1/34409; F01L 2001/3443; F01L 2001/34426; F01L 2001/34469; F01L 2001/34479; F01L 2001/34433; F01L 2001/34436
USPC ..... 123/90.15–90.18
See application file for complete search history.

(56) References Cited

U.S. PATENT DOCUMENTS 6,772,721 B1 8/2004 Gardner et al.
7,000,580 B1 2/2006 Smith et al.
7,137,371 B2 11/2006 Simpson et al.
8,534,246 B2 9/2013 Lichti et al.
9,587,526 B2 3/2017 Lichti
9,958,076 B2 * 5/2018 Kobayashi ..... F16K 17/26
10,082,054 B2 9/2018 Haltiner, Jr. et al.
2009/0159024 A1 6/2009 Paul et al.
2012/0097122 A1 * 4/2012 Lichti ..... F01L 1/3442 123/90.15
2012/0145099 A1 * 6/2012 Kato ..... F15B 15/12 123/90.15
2013/0199469 A1 * 8/2013 Busse ..... F01L 1/3442 123/90.15
2013/0206088 A1 8/2013 Wigsten
2015/0218976 A1 * 8/2015 Last ..... F01L 1/3442 123/90.15
2016/0024978 A1 * 1/2016 Lichti ..... F01L 1/3442 123/90.15

(Continued)

*Primary Examiner* — Charles G Freay
*Assistant Examiner* — Kelsey L Stanek
(74) *Attorney, Agent, or Firm* — Joshua M. Haines

(57) ABSTRACT

A camshaft phaser includes an input member and an output member. A valve spool is moveable along an axis between an advance position and a retard position and includes a valve spool bore. A check valve within the valve spool bore includes a check valve member which moves between a seated position and an unseated position such that the check valve member prevents fluid flow out of the valve spool bore through a passage and such that the check valve member permits flow into the valve spool bore through the passage. An insert within the valve spool bore supports the check valve closes one end of the valve spool bore and abuts an insert retainer to retain the insert within the valve spool bore. A spring urges the insert toward the insert retainer and holds the insert retainer in compression against the insert retainer.

20 Claims, 22 Drawing Sheets

(56) References Cited

U.S. PATENT DOCUMENTS

| | | | | |
|---|---|---|---|---|
| 2017/0130617 | A1* | 5/2017 | Haltiner, Jr. | F01L 1/3442 |
| 2017/0130618 | A1* | 5/2017 | Haltiner, Jr. | F01L 1/047 |
| 2017/0198612 | A1* | 7/2017 | Noguchi | F01L 1/047 |
| 2018/0135471 | A1 | 5/2018 | Kajita et al. | |
| 2018/0156079 | A1* | 6/2018 | Yamakawa | F01L 1/3442 |
| 2018/0245488 | A1* | 8/2018 | Hamasaki | F16K 15/183 |
| 2018/0355766 | A1* | 12/2018 | Leblay | F01L 1/053 |
| 2019/0063270 | A1* | 2/2019 | Haltiner, Jr. | F01L 1/3442 |
| 2019/0085736 | A1* | 3/2019 | Stanhope | F01L 1/344 |
| 2019/0107014 | A1* | 4/2019 | Smith | F01L 1/3442 |

* cited by examiner

CAMSHAFT PHASER

TECHNICAL FIELD OF INVENTION

The present invention relates to a camshaft phaser for varying the phase relationship between a crankshaft and a camshaft in an internal combustion engine; more particularly to such a camshaft phaser which includes a valve for changing position of the camshaft phaser.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vacated from the other of the advance and retard chambers by a phasing oil control valve in order to rotate the rotor within the stator and thereby change the phase relationship between the camshaft and the crankshaft. A supply check valve is typically provided in order to prevent oil from flowing back to the source of the engine oil. It is also common to include a lock pin which is selectively engaged and disengaged with a lock pin seat. When the lock pin is engaged with the lock pin seat, rotation of the rotor relative to the stator is prevented. Conversely, when the lock pin is disengaged from the lock pin, rotation of the rotor relative to the stator is permitted based on input from the phasing oil control valve. One such camshaft phaser is described in U.S. Pat. No. 6,772,721 to Gardner et al., hereinafter referred to as Gardner et al. While the camshaft phaser of Gardner et al. may be effective, it may be difficult to implement the check valve within the rotor as taught by Gardner et al. In order to achieve compactness and simplify oil passages, it may be desirable to implement the check valve within the valve spool.

U.S. Pat. No. 10,082,054 to Haltiner Jr., et al., the entire disclosure of which is incorporated herein by reference in its entirety, discloses another such camshaft phaser. In Haltiner Jr. et al., the check valve is implemented within the valve spool together with an insert which separates the interior of the valve spool into a phasing chamber and a vent chamber which are fluidly segregated. While Haltiner Jr. et al. may be effective, it may be challenging to provide a seal between the interface of the insert and the valve spool and the check valve may be subject to relative movement between the check valve and the insert which may promote wear over the expected service life of the camshaft phaser.

What is needed is camshaft phaser which minimizes or eliminates one or more the shortcomings as set forth above.

SUMMARY OF THE INVENTION

Briefly described, a camshaft phaser is provided for use with an internal combustion engine for controllably varying the phase relationship between a crankshaft and a camshaft in the internal combustion engine. The camshaft phaser includes an input member connectable to the crankshaft of the internal combustion engine to provide a fixed ratio of rotation, about an axis of rotation, between the input member and the crankshaft; an output member connectable to the camshaft of the internal combustion engine and defining an advance chamber and a retard chamber with the input member; a valve spool moveable along the axis of rotation between an advance position and a retard position and having a valve spool bore extending thereinto along the axis of rotation, wherein the advance position allows oil to be vented from the advance chamber and to be supplied to the retard chamber from the valve spool bore in order to advance the timing of the camshaft relative to the crankshaft and wherein the retard position allows oil to be vented from the retard chamber and to be supplied to the advance chamber from the valve spool bore in order to retard the timing of the camshaft relative to the crankshaft; a check valve within the valve spool bore, the check valve including a check valve member which moves between a seated position and an unseated position such that the check valve member prevents fluid flow out of the valve spool bore through a passage and such that the check valve member permits flow into the valve spool bore through the passage; an insert within the valve spool bore such that the insert supports the check valve within the valve spool bore and sealingly closes one end of the valve spool bore; an insert retainer with which the insert is abutted and retains the insert within the valve spool bore; and a spring which urges the insert toward the insert retainer and holds the insert retainer in compression against the insert retainer. The camshaft phaser including the valve spool, the insert, and the check valve as described herein allows for simplified construction of the camshaft phaser compared to the prior art and ensures that the check valve and insert remain static within the valve spool during operation.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
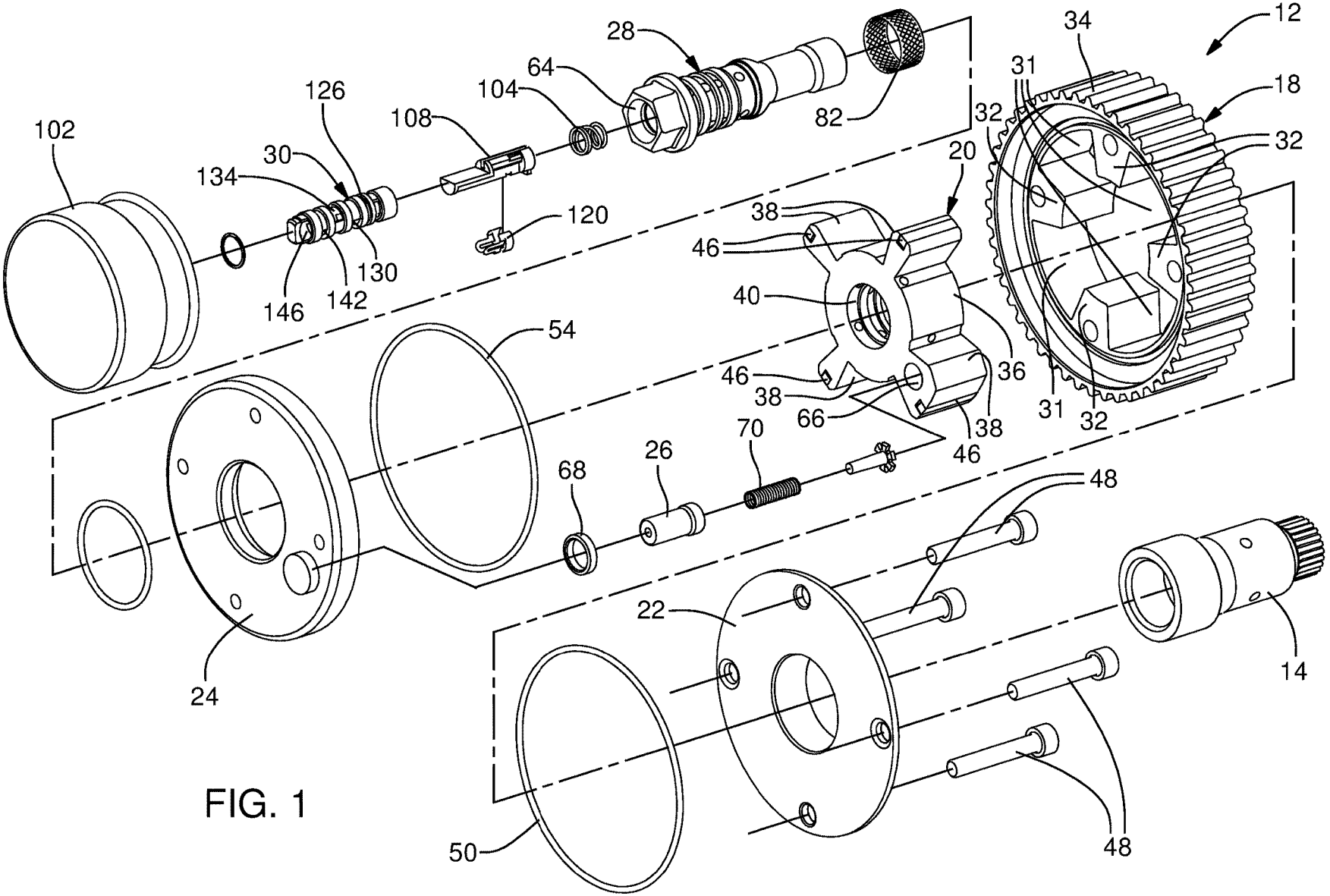
FIG. 1 is an exploded isometric view of a camshaft phaser.

Referring to FIGS. 1-4, an internal combustion engine 10 is shown which includes a camshaft phaser 12. Internal combustion engine 10 also includes a camshaft 14 which is rotatable about an axis of rotation 16 based on rotational input from a crankshaft and belt (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18 which acts and an input member, a rotor 20 disposed coaxially within stator 18 which acts as an output member, a back cover 22 closing off one end of stator 18, a front cover 24 closing off the other end of stator 18, a lock pin 26, a camshaft phaser attachment bolt 28 for attaching camshaft phaser 12 to camshaft 14, and a valve spool 30. The various elements of camshaft phaser 12 will be described in greater detail in the paragraphs that follow.

Stator 18 is generally cylindrical and includes a plurality of radial chambers 31 defined by a plurality of lobes 32 extending radially inward. In the embodiment shown, there are four lobes 32 defining four radial chambers 31, however, it is to be understood that a different number of lobes 32 may be provided to define radial chambers 31 equal in quantity to the number of lobes 32. Stator 18 may also include a toothed pulley 34 formed integrally therewith or otherwise fixed thereto. Pulley 34 is configured to be driven by a belt that is driven by the crankshaft of internal combustion engine 10. Alternatively, pulley 34 may be a sprocket driven by a chain or any other known drive member known for driving camshaft phaser 12 by the crankshaft.

Rotor 20 includes a central hub 36 with a plurality of vanes 38 extending radially outward therefrom and a rotor central through bore 40 extending axially therethrough. The number of vanes 38 is equal to the number of radial chambers 31 provided in stator 18. Rotor 20 is coaxially disposed within stator 18 such that each vane 38 divides each radial chamber 31 into advance chambers 42 and retard chambers 44. The radial tips of lobes 32 are mateable with central hub 36 in order to separate radial chambers 31 from each other. Each of the radial tips of vanes 38 may include one of a plurality of wiper seals 46 to substantially seal adjacent advance chambers 42 and retard chambers 44 from each other. While not shown, each of the radial tips of lobes 32 may also include one of a plurality of wiper seals 46.

Back cover 22 is sealingly secured, using cover bolts 48, to the axial end of stator 18 that is proximal to camshaft 14. Tightening of cover bolts 48 prevents relative rotation between back cover 22 and stator 18. A back cover seal 50, for example only, an O-ring, may be provided between back cover 22 and stator 18 in order to provide an oil-tight seal between the interface of back cover 22 and stator 18. Back cover 22 includes a back cover central bore 52 extending coaxially therethrough. The end of camshaft 14 is received coaxially within back cover central bore 52 such that camshaft 14 is allowed to rotate relative to back cover 22. In an alternative arrangement, pulley 34 may be integrally formed or otherwise attached to back cover 22 rather than stator 18.

Similarly, front cover 24 is sealingly secured, using cover bolts 48, to the axial end of stator 18 that is opposite back cover 22. A front cover seal 54, for example only, an O-ring, may be provided between front cover 24 and stator 18 in order to provide an oil-tight seal between the interface of front cover 24 and stator 18. Cover bolts 48 pass through back cover 22 and stator 18 and threadably engage front cover 24, thereby clamping stator 18 between back cover 22 and front cover 24 to prevent relative rotation between stator 18, back cover 22, and front cover 24. In this way, advance chambers 42 and retard chambers 44 are defined axially between back cover 22 and front cover 24.

Camshaft phaser 12 is attached to camshaft 14 with camshaft phaser attachment bolt 28 which extends coaxially through rotor central through bore 40 of rotor 20 and threadably engages camshaft 14, thereby by clamping rotor 20 securely to camshaft 14. In this way, relative rotation between stator 18 and rotor 20 results in a change is phase or timing between the crankshaft of internal combustion engine 10 and camshaft 14.

Pressurized oil is selectively supplied to advance chambers 42 from an oil source 55, which may be an oil pump of internal combustion engine 10, while oil is simultaneously vented from retard chambers 44 in order to cause relative rotation between stator 18 and rotor 20 which results in retarding the timing of camshaft 14 relative to the crankshaft of internal combustion engine 10. Conversely, pressurized oil is selectively supplied to retard chambers 44 from oil source 55 while oil is simultaneously vented from advance chambers 42 in order to cause relative rotation between stator 18 and rotor 20 which results in advancing the timing of camshaft 14 relative to the crankshaft of internal combustion engine 10. Rotor advance passages 56 may be provided in rotor 20 for supplying and venting oil to and from advance chambers 42 while rotor retard passages 58 may be provided in rotor 20 for supplying and venting oil to and from retard chambers 44. Supplying and venting oil to and from advance chambers 42 and to and from retard chambers 44 is controlled by valve spool 30, as will be described in detail later, such that valve spool 30 is coaxially disposed slidably within a valve bore 64 of camshaft phaser attachment bolt 28 where valve bore 64 is centered about axis of rotation 16.

Lock pin 26 selectively prevents relative rotation between stator 18 and rotor 20 at a predetermined aligned position of rotor 20 within stator 18, which as shown, may be a full advance position, i.e. rotor 20 as far as possible within stator 18 in the advance direction of rotation. Lock pin 26 is slidably disposed within a lock pin bore 66 formed in one vane 38 of rotor 20. A lock pin seat 68 is provided in front cover 24 for selectively receiving lock pin 26 therewithin. Lock pin 26 and lock pin seat 68 are sized to substantially prevent rotation between stator 18 and rotor 20 when lock pin 26 is received within lock pin seat 68. When lock pin 26 is not desired to be seated within lock pin seat 68, pressurized oil is supplied to lock pin bore 66 through a rotor lock pin passage 72 formed in rotor 20, thereby urging lock pin 26 out of lock pin seat 68 and compressing a lock pin spring 70. Conversely, when lock pin 26 is desired to be seated within lock pin seat 68, the pressurized oil is vented from lock pin bore 66 through rotor lock pin passage 72, thereby allowing lock pin spring 70 to urge lock pin 26 toward front cover 24. In this way, lock pin 26 is seated within lock pin seat 68 by lock pin spring 70 when rotor 20 is positioned within stator 18 to allow alignment of lock pin 26 with lock pin seat 68. Supplying and venting of pressurized oil to and from lock pin 26 is controlled by valve spool 30 as will be described later.

Camshaft phaser attachment bolt 28 and valve spool 30, which act together to function as a valve, will now be described in greater detail with continued reference to FIGS. 1-4 and now with additional reference to FIGS. 5A-14. Camshaft phaser attachment bolt 28 includes bolt supply passages 74 which extend radially outward from valve bore 64 to the outside surface of camshaft phaser attachment bolt 28. Bolt supply passages 74 receive pressurized oil from oil source 55 via an annular oil supply passage 78 formed radially between camshaft phaser attachment bolt 28 and a counter bore of camshaft 14 and also via radial camshaft oil passages 80 of camshaft 14. The pressurized oil from oil source 55 is used to 1) selectively supply oil to advance chambers 42, 2) selectively supply oil to retard chambers 44, and 3) selectively disengage lock pin 26 from lock pin seat 68. A filter 82 may circumferentially surround camshaft phaser attachment bolt 28 at bolt supply passages 74 in order to prevent foreign matter that may be present in the oil from reaching valve spool 30.

Camshaft phaser attachment bolt 28 also includes a bolt annular lock pin groove 84 on the outer periphery of camshaft phaser attachment bolt 28 and bolt lock pin passages 86 extend radially outward from valve bore 64 to bolt annular lock pin groove 84. Bolt annular lock pin groove 84 is spaced axially apart from bolt supply passages 74 in a direction away from camshaft 14 and is aligned with a rotor annular lock pin groove 88 which extends radially outward from rotor central through bore 40 such that rotor lock pin passage 72 extends from rotor annular lock pin groove 88 to lock pin bore 66. In this way, fluid communication is provided between valve bore 64 and lock pin bore 66.

Camshaft phaser attachment bolt 28 also includes a bolt annular advance groove 90 on the outer periphery of camshaft phaser attachment bolt 28 and bolt advance passages 92 extend radially outward from valve bore 64 to bolt annular advance groove 90. Bolt annular advance groove 90 is spaced axially apart from bolt supply passages 74 and bolt annular lock pin groove 84 such that bolt annular lock pin groove 84 is axially between bolt supply passages 74 and bolt annular advance groove 90. Bolt annular advance groove 90 is aligned with a rotor annular advance groove 94 which extends radially outward from rotor central through bore 40 such that rotor advance passages 56 extend from rotor annular advance groove 94 to advance chambers 42. In this way, fluid communication is provided between valve bore 64 and advance chambers 42.

Camshaft phaser attachment bolt 28 also includes a bolt annular retard groove 96 on the outer periphery of camshaft phaser attachment bolt 28 and bolt retard passages 98 extend radially outward from valve bore 64 to bolt annular retard groove 96. Bolt annular retard groove 96 is spaced axially apart from bolt annular advance groove 90 such that bolt annular advance groove 90 is axially between bolt annular lock pin groove 84 and bolt annular retard groove 96. Bolt annular retard groove 96 and is aligned with a rotor annular retard groove 100 which extends radially outward from rotor central through bore 40 such that rotor retard passages 58 extend from rotor annular retard groove 100 to retard chambers 44. In this way, fluid communication is provided between valve bore 64 and retard chambers 44.

Valve spool 30 is moved axially along axis of rotation 16 within valve bore 64 of camshaft phaser attachment bolt 28 by an actuator 102 and a valve spring 104 to achieve desired operational states of camshaft phaser 12 by opening and closing bolt supply passages 74, bolt lock pin passages 86, bolt advance passages 92, and bolt retard passages 98 as will now be described. Valve spool 30 includes a valve spool bore 106 extending axially thereinto from the end of valve spool 30 that is proximal to camshaft 14. An insert 108 is disposed within valve spool bore 106 such that insert 108 defines a phasing volume 110 and a venting volume 112 (best visible in FIG. 11) such that phasing volume 110 is substantially fluidly segregated from venting volume 112, i.e. phasing volume 110 does not communicate with venting volume 112. By way of non-limiting example only, insert 108 may be net-formed by plastic injection molding and may be easily inserted within valve spool bore 106 from the end of valve spool bore 106 that is proximal to valve spring 104 prior to valve spool 30 being inserted into valve bore 64 of camshaft phaser attachment bolt 28. In this way, phasing volume 110 and venting volume 112 are easily and economically formed.

Valve spool 30 also includes a supply land 114 which is sized to fit within valve bore 64 in a close sliding relationship such that oil is substantially prevented from passing between the interface between supply land 114 and valve bore 64 while allowing valve spool 30 to be displaced axially within valve bore 64 substantially uninhibited.

Valve spool 30 also includes a spool annular supply groove 116 that is axially adjacent to supply land 114. A spool supply passage **118*a* and a spool supply passage 118*b* are provided such that spool supply passage 118*a* and spool supply passage 118*b* each extend radially inward from spool annular supply groove 116 to phasing volume 110 within valve spool bore 106 and such that spool supply passage 118*a* is diametrically opposed to spool supply passage 118*b*. Spool supply passage 118*a* and spool supply passage 118*b* are both preferably slots which extend in a circumferential direction about axis of rotation 16 further than in the direction of axis of rotation 16. A supply check valve 120 is disposed within phasing volume 110, as will be described in greater detail later, in order to allow oil to enter phasing volume 110 from spool supply passage 118*a* and from spool supply passage 118*b* while substantially preventing oil from exiting phasing volume 110 to spool supply passage 118*a* and to spool supply passage 118*b***.

Valve spool 30 also includes a lock pin land 122 that is axially adjacent to spool annular supply groove 116. Lock pin land 122 is sized to fit within valve bore 64 in a close sliding relationship such that oil is substantially prevented from passing between the interface between lock pin land 122 and valve bore 64 while allowing valve spool 30 to be displaced axially within valve bore 64 substantially uninhibited. Lock pin land 122 is axially divided by an spool annular lock pin groove 124 such that a spool lock pin passage 126 (best visible in FIG. 14) extends radially inward from spool annular lock pin groove 124 to venting volume 112 within valve spool bore 106, thereby providing fluid communication between spool annular lock pin groove 124 and venting volume 112.

Valve spool 30 also includes a spool annular advance groove 128 that is axially adjacent to lock pin land 122. A spool advance passage 130 is provided which extends radially inward from spool annular advance groove 128 to phasing volume 110 within valve spool bore 106 in order to provide fluid communication between spool annular advance groove 128 and phasing volume 110. Spool advance passage 130 is preferably a slot which extends in a circumferential direction about axis of rotation 16 further than in the direction of axis of rotation 16 and preferably extends circumferentially about half of the way around spool annular advance groove 128.

Valve spool 30 also includes an advance land 131 that is axially adjacent to spool annular advance groove 128. Advance land 131 is sized to fit within valve bore 64 in a close sliding relationship such that oil is substantially prevented from passing between the interface between advance land 131 and valve bore 64 while allowing valve spool 30 to be displaced axially within valve bore 64 substantially uninhibited.

Valve spool 30 also includes a spool annular vent groove 132 that is axially adjacent to advance land 131. A spool vent passage 134 (best visible in FIGS. 12 and 14) is provided such that spool vent passage 134 extends radially inward from spool annular vent groove 132 to phasing volume 110 within valve spool bore 106. Spool vent passage 134 is preferably a slot which extends in a circumferential direction about axis of rotation 16 further than in the direction of axis of rotation 16 and preferably extends circumferentially about half of the way around spool annular vent groove 132.

Valve spool 30 also includes a retard land 138 that is axially adjacent to spool annular vent groove 132. Retard land 138 is sized to fit within valve bore 64 in a close sliding relationship such that oil is substantially prevented from passing between the interface between retard land 138 and valve bore 64 while allowing valve spool 30 to be displaced axially within valve bore 64 substantially uninhibited.

Valve spool 30 also includes a spool annular retard groove 140 that is axially adjacent to retard land 138. A spool retard passage 142 is provided such that spool retard passage 142 extends radially inward from spool annular retard groove 140 to phasing volume 110 within valve spool bore 106 in order to provide fluid communication between spool annular retard groove 140 and phasing volume 110. Spool retard passage 142 is preferably a slot which extends in a circumferential direction about axis of rotation 16 further than in the direction of axis of rotation 16 and preferably extends circumferentially about half of the way around spool annular retard groove 140.

Valve spool 30 also includes an end land 144 that is axially adjacent to spool annular retard groove 140. End land 144 is sized to fit within valve bore 64 in a close sliding relationship such that oil is substantially prevented from passing between the interface between end land 144 and valve bore 64 while allowing valve spool 30 to be displaced axially within valve bore 64 substantially uninhibited.

Valve spool 30 also includes vent passages 146 which extend radially outward from venting volume 112, thereby allowing oil within venting volume 112 to be vented to valve bore 64 and out of camshaft phaser 12 where it may be drained back to oil source 55. Alternatively, a passage could be formed in camshaft phaser attachment bolt 28 which extends from valve bore 64 to a drain passage in camshaft 14 in order to vent oil within venting volume 112 where it may be drained back to oil source 55.

Figure 5A:
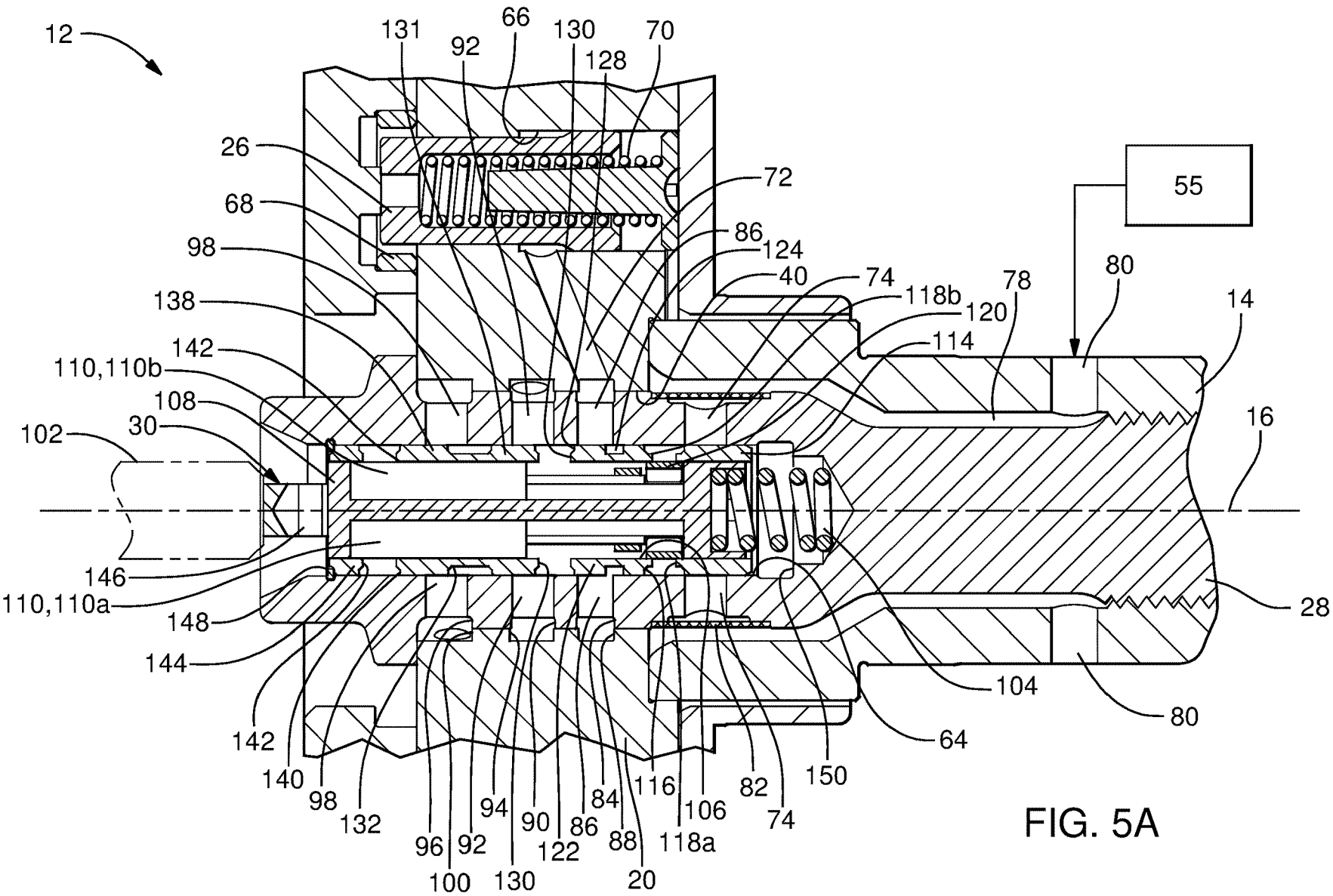
FIG. 5A is an enlarged portion of FIG. 4 showing a valve spool of the camshaft phaser in a default position with a lock pin engaged with a lock pin seat.
Figure 5B:
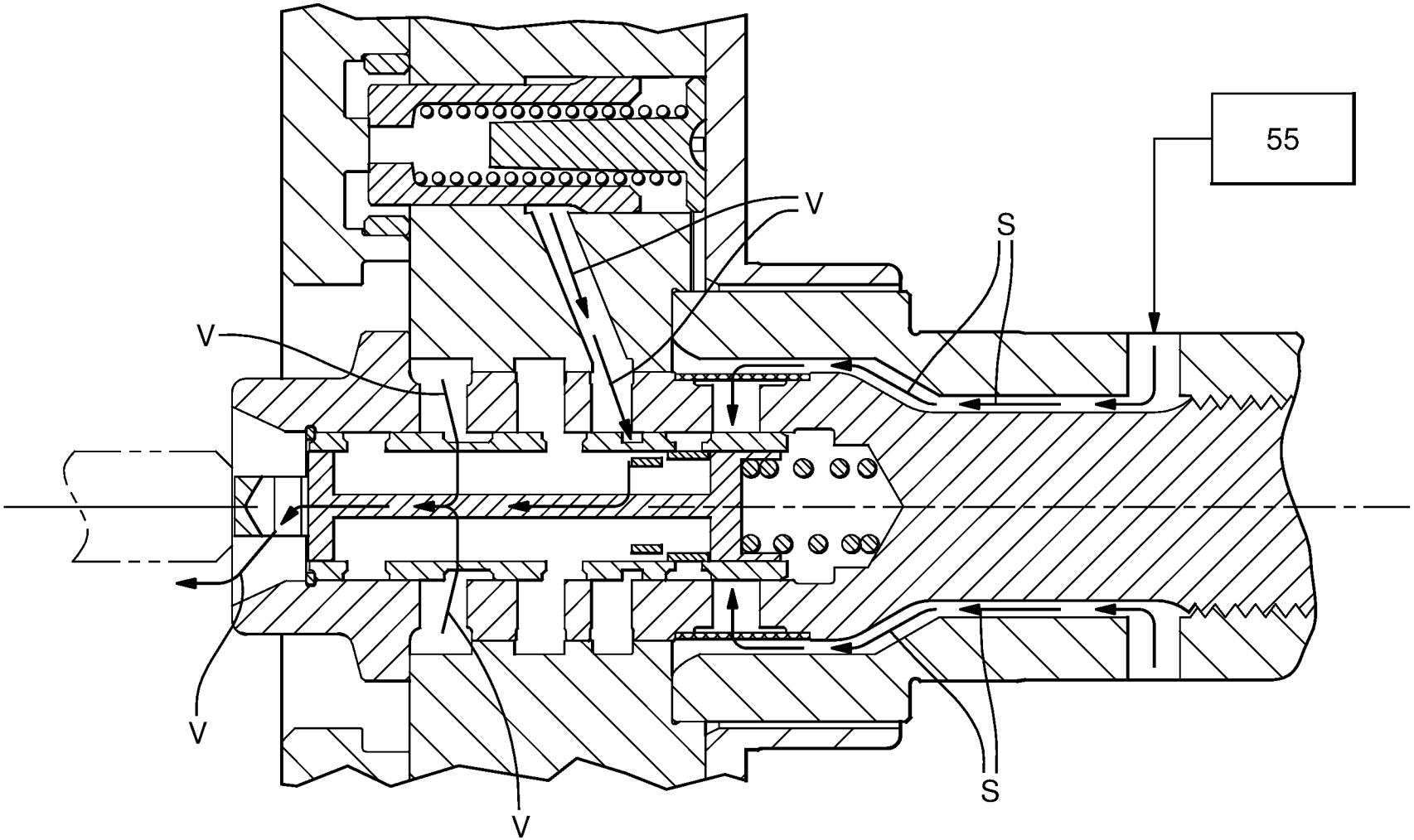
FIG. 5B is the view of FIG. 5A shown with reference numbers removed in order to clearly shown the path of travel of oil.

Actuator 102 may be a solenoid actuator that is selectively energized with an electric current of varying magnitude in order to position valve spool 30 within valve bore 64 at desired axial positions, thereby controlling oil flow to achieve desired operation of camshaft phaser 12. In a default position, when no electric current is supplied to actuator 102 as shown in FIGS. 5A and 5B, valve spring 104 urges valve spool 30 in a direction toward actuator 102 until valve spool 30 axially abuts a first stop member 148, which may be, by way of non-limiting example only, a snap ring within a snap ring groove extending radially outward from valve bore 64. In the default position, supply land 114 is positioned to provide fluid communication between bolt supply passages 74 and spool annular supply groove 116, thereby allowing pressurized oil to be supplied to phasing volume 110 through spool supply passages 118*a*,118*b* and supply check valve 120 from oil source 55. Also in the default position, lock pin land 122 is positioned to align spool annular lock pin groove 124 with bolt lock pin passages 86, thereby allowing oil to be vented from lock pin bore 66 via rotor lock pin passage 72, rotor annular lock pin groove 88, bolt annular lock pin groove 84, bolt lock pin passages 86, spool annular lock pin groove 124, spool lock pin passage 126, venting volume 112, and vent passages 146 and consequently allowing lock pin spring 70 to urge lock pin 26 toward front cover 24. In the default position, lock pin land 122 also blocks fluid communication between bolt lock pin passages 86 and phasing volume 110. Also in the default position, advance land 131 is positioned to block fluid communication between bolt advance passages 92 and spool annular vent groove 132 while simultaneously permitting fluid communication between bolt advance passages 92 and phasing volume 110 via spool annular advance groove 128 and spool advance passage 130. Also in the default position, retard land 138 is positioned to block fluid communication between phasing volume 110 and bolt retard passages 98 while simultaneously permitting fluid communication between bolt retard passages 98 and venting volume 112 via spool annular vent groove 132, and spool vent passage 134. In this way, pressurized oil that is supplied to phasing volume 110 from oil source 55 is supplied to advance chambers 42 via spool advance passage 130, spool annular advance groove 128, bolt advance passages 92, bolt annular advance groove 90, rotor annular advance groove 94, and rotor advance passages 56 while oil is simultaneously vented from retard chambers 44 via rotor retard passages 58, rotor annular retard groove 100, bolt annular retard groove 96, bolt retard passages 98, spool annular vent groove 132, spool vent passage 134, venting volume 112, and vent passages 146, thereby causing rotor 20 to rotate relative to stator 18 to cause a retard in timing of camshaft 14 relative to the crankshaft, and when lock pin 26 is aligned with lock pin seat 68, lock pin spring 70 urges lock pin 26 into lock pin seat 68 to retain rotor 20 in the predetermined aligned position with stator 18. In FIG. 5B, the reference numbers have been removed for clarity and arrows representing the path of travel of the oil have been included where arrows S represent oil from oil source 55 that is supplied to advance chambers 42 and arrows V represent vented oil from lock pin bore 66 and from retard chambers 44. It should be noted that FIG. 5B shows supply check valve 120 being open, but supply check valve 120 may also be closed if a torque reversal acting on camshaft 14 causes the pressure within phasing volume 110 to be greater than the pressure of oil from oil source 55.

Figure 6A:
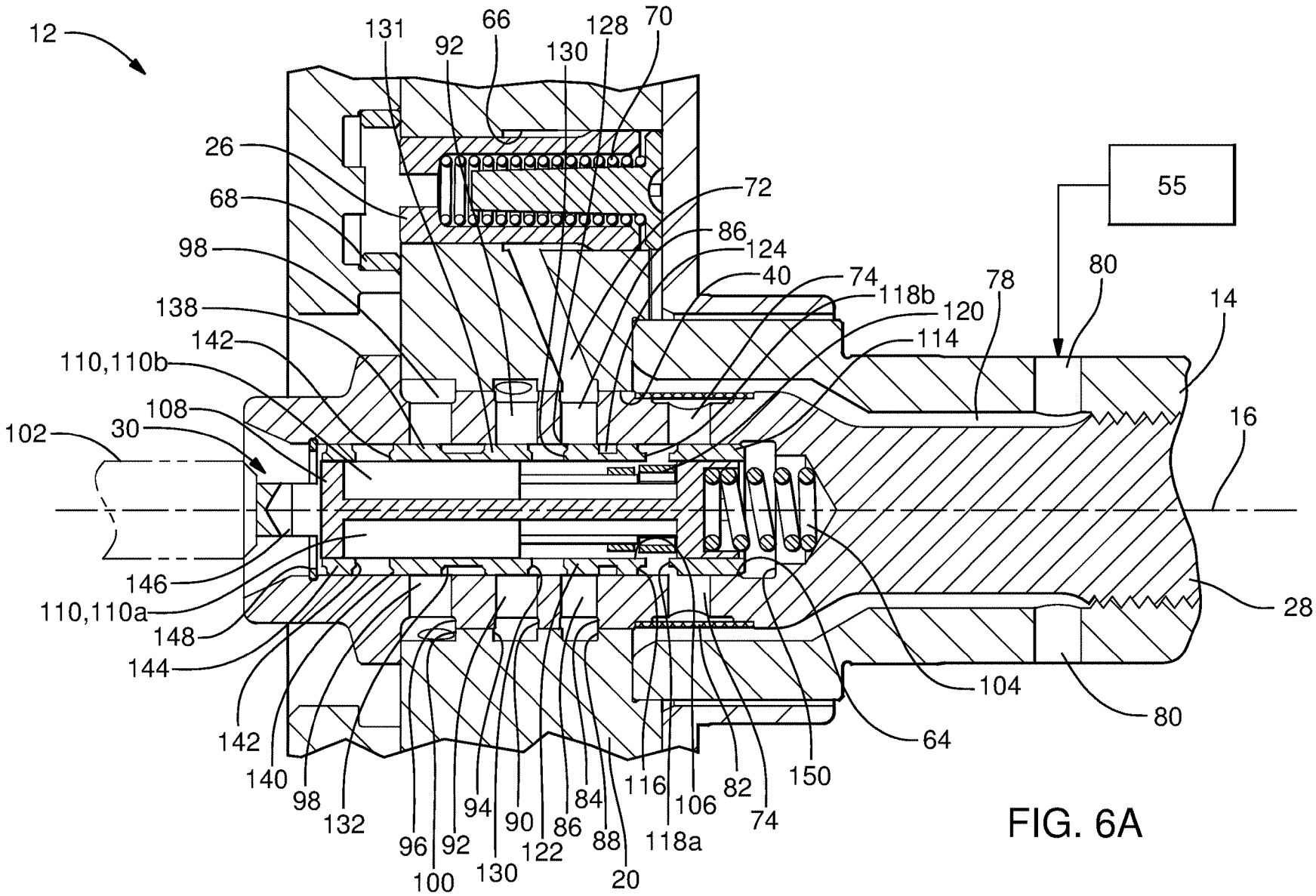
FIG. 6A is the view of FIG. 5A now shown with the valve spool in a retard position now with the lock pin retracted from the lock pin seat.
Figure 6B:
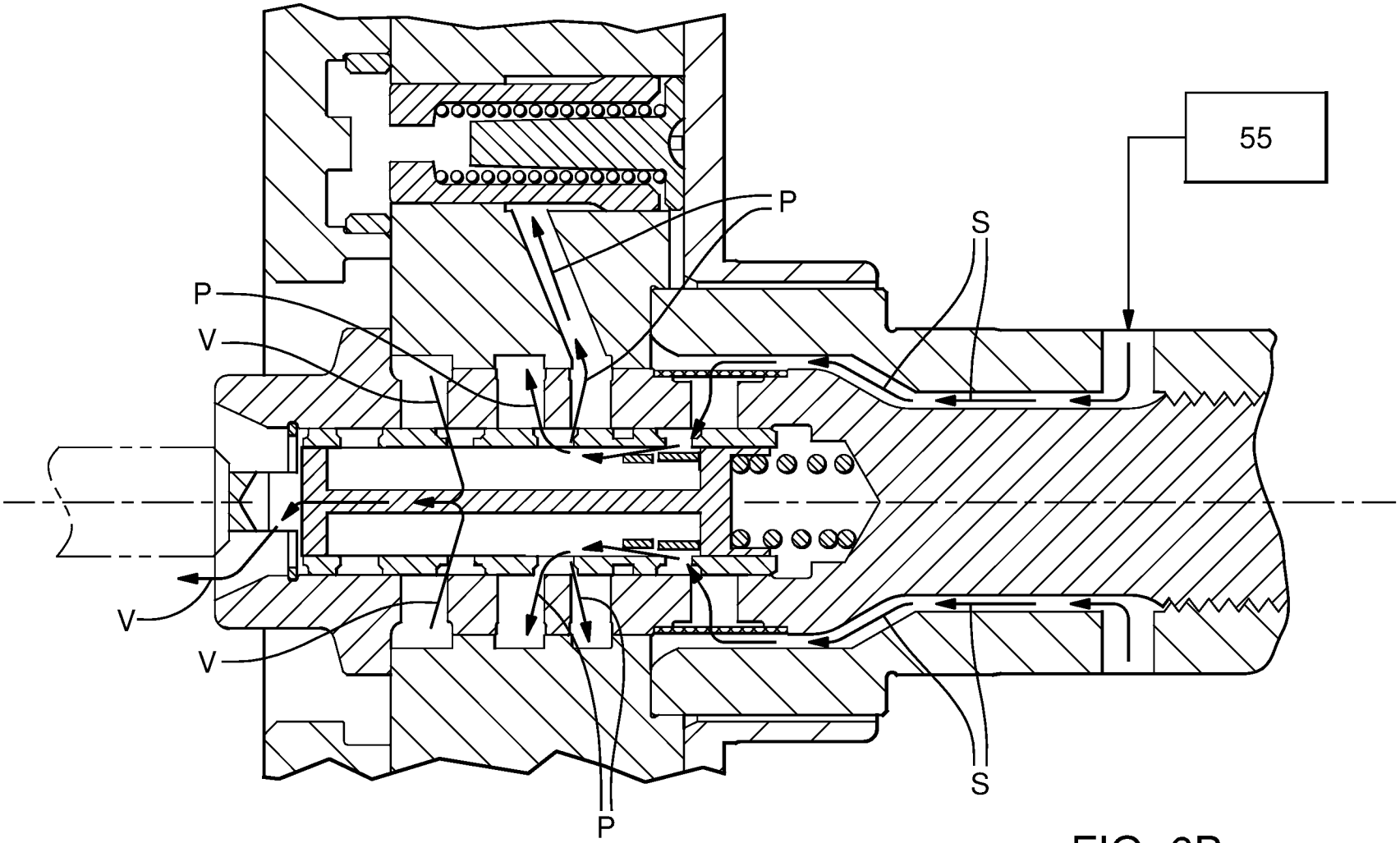
FIG. 6B is the view of FIG. 6A shown with reference numbers removed and arrows added in order to clearly show the path of travel of oil.

In a retard position, when an electric current of a first magnitude is supplied to actuator 102 as shown in FIGS. 6A and 6B, actuator 102 urges valve spool 30 in a direction toward valve spring 104 thereby causing valve spring 104 to be compressed slightly. In the retard position, supply land 114 is positioned to provide fluid communication between bolt supply passages 74 and spool annular supply groove 116, thereby allowing pressurized oil to be supplied to phasing volume 110 through spool supply passages 118*a*, 118*b* and supply check valve 120 from oil source 55. Also in the retard position, lock pin land 122 is positioned to prevent fluid communication between bolt lock pin passages 86 and spool annular lock pin groove 124, thereby preventing oil from being vented from lock pin bore 66. Also in the retard position, lock pin land 122 is positioned to permit fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the retard position, advance land 131 is positioned to block fluid communication between bolt advance passages 92 and spool annular vent groove 132 while simultaneously permitting fluid communication between bolt advance passages 92 and phasing volume 110 via spool annular advance groove 128 and spool advance passage 130. Also in the retard position, retard land 138 is positioned to block fluid communication between phasing volume 110 and bolt retard passages 98 while simultaneously permitting fluid communication between bolt retard passages 98 and venting volume 112 via spool annular vent groove 132, and spool vent passage 134. In this way, pressurized oil that is supplied to phasing volume 110 from oil source 55 is supplied to advance chambers 42 via spool advance passage 130, spool annular advance groove 128, bolt advance passages 92, bolt annular advance groove 90, rotor annular advance groove 94, and rotor advance passages 56 while oil is simultaneously vented from retard chambers 44 via rotor retard passages 58, rotor annular retard groove 100, bolt annular retard groove 96, bolt retard passages 98, spool annular vent groove 132, spool vent passage 134, venting volume 112, and vent passages 146, thereby causing rotor 20 to rotate relative to stator 18 to cause a retard in timing of camshaft 14 relative to the crankshaft. In FIG. 6B, the reference numbers have been removed for clarity and arrows representing the path of travel of the oil have been included where arrows S represent oil from oil source 55 that is supplied to advance chambers 42 and to lock pin bore 66 and arrows V represent vented oil from retard chambers 44. It should be noted that FIG. 6B shows supply check valve 120 being open, but supply check valve 120 may also be closed if a torque reversal acting on camshaft 14 causes the pressure within phasing volume 110 to be greater than the pressure of oil from oil source 55.

Figure 7A:
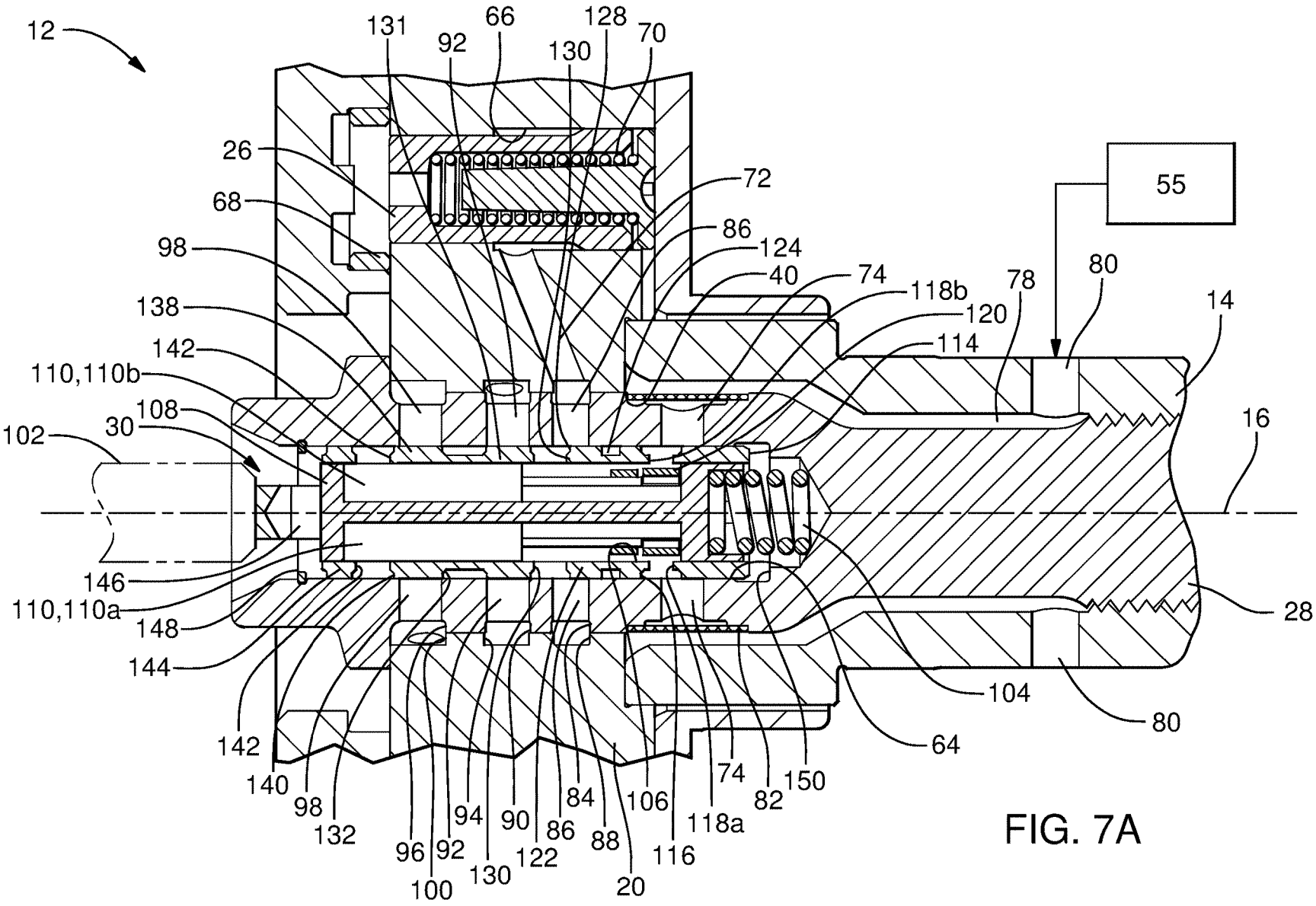
FIG. 7A is the view of FIG. 5A now shown with the valve spool in a hold position now with the lock pin retracted from the lock pin seat.
Figure 7B:
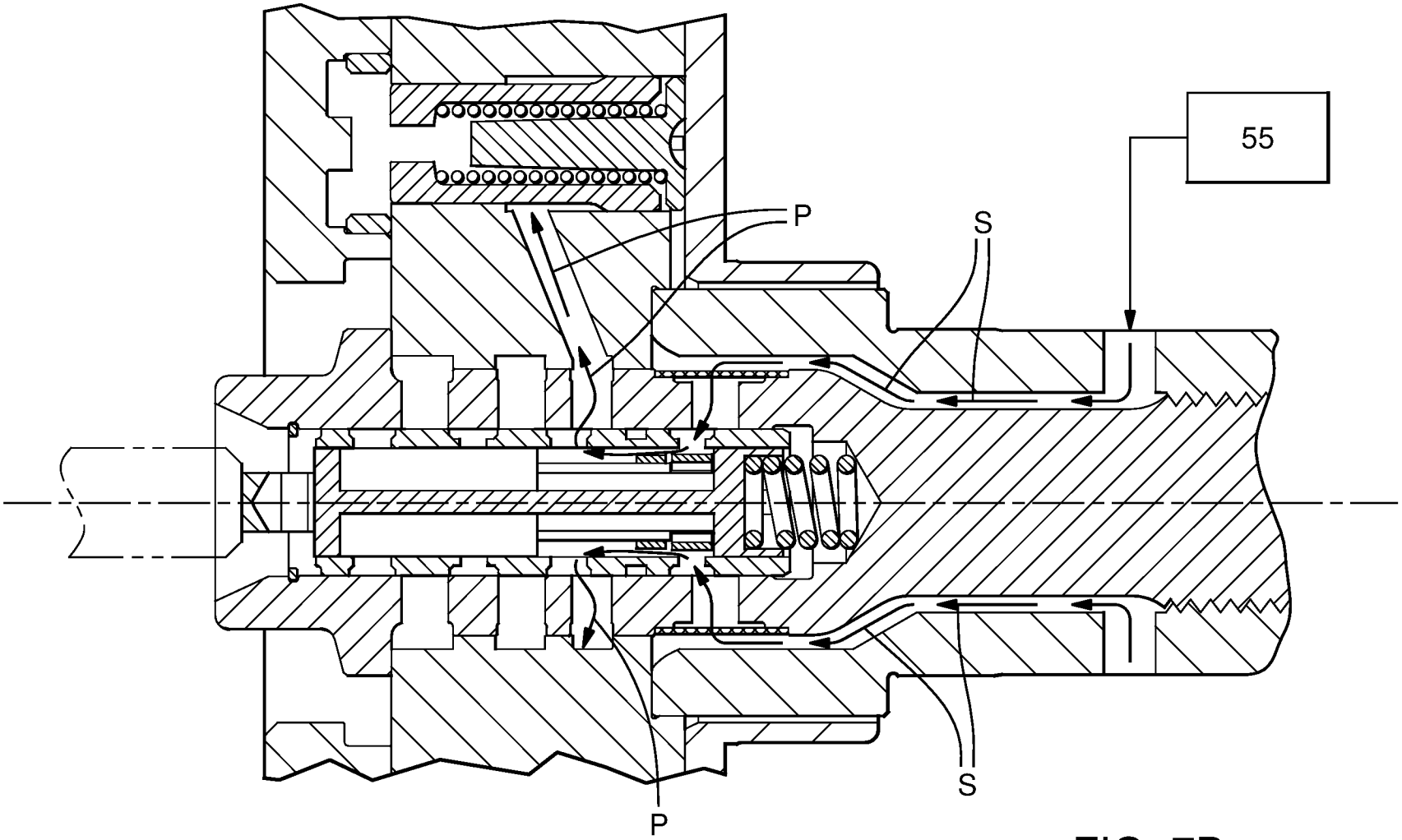
FIG. 7B is the view of FIG. 7A shown with reference numbers removed and arrows added in order to clearly show the path of travel of oil.

In a hold position, when an electric current of a second magnitude is supplied to actuator 102 as shown in FIGS. 7A and 7B, actuator 102 urges valve spool 30 in a direction toward valve spring 104 thereby causing valve spring 104 to be compressed slightly more than in the retard position. In the hold position, supply land 114 is positioned to provide fluid communication between bolt supply passages 74 and spool annular supply groove 116, thereby allowing pressurized oil to be supplied to phasing volume 110 through spool supply passages 118*a*,118*b* and supply check valve 120 from oil source 55. Also in the hold position, lock pin land 122 is positioned to prevent fluid communication between bolt lock pin passages 86 and spool annular lock pin groove 124, thereby preventing oil from being vented from lock pin bore 66. Also in the hold position, lock pin land 122 is positioned to permit fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the hold position, advance land 131 is positioned to block fluid communication between bolt advance passages 92 and spool annular vent groove 132 while simultaneously permitting restricted communication between bolt advance passages 92 and phasing volume 110 via spool annular advance groove 128 and spool advance passage 130. Also in the hold position, retard land 138 is positioned to block fluid communication between bolt retard passages 98 and spool annular vent groove 132 while simultaneously permitting restricted fluid communication between bolt retard passages 98 and phasing volume 110 via spool annular retard groove 140 and spool retard passage 142. By providing restricted fluid communication between bolt advance passages 92 and phasing volume 110 and between bolt retard passages 98 and phasing volume 110 while simultaneously blocking fluid communication between bolt advance passages 92 and spool annular vent groove 132 and between bolt retard passages 98 and spool annular vent groove 132, the rotational position of rotor 20 and stator 18 is substantially maintained in the hold position. In FIG. 7B, the reference numbers have been removed for clarity and arrows representing the path of travel of the oil have been included where arrows S represent oil from oil source 55 which retracts lock pin 26 from lock pin seat 68 and which is supplied restrictingly to advance chambers 42 and retard chambers 44. It should be noted that FIG. 7B shows supply check valve 120 being open, but may typically remain closed unless lock pin 26 is in the process of being retracted from lock pin seat 68.

Figure 8A:
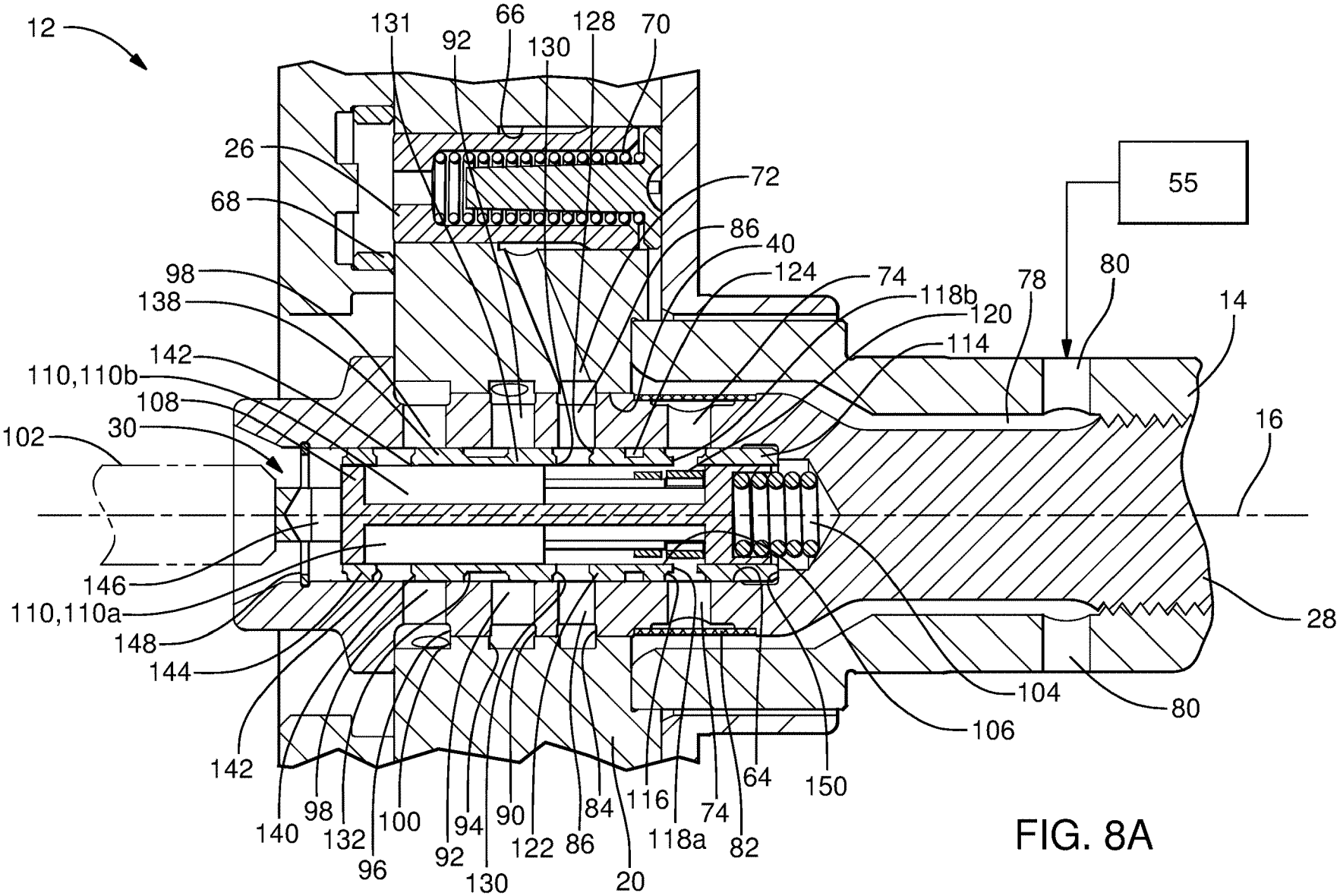
FIG. 8A is the view of FIG. 5A now shown with the valve spool in an advance position now with the lock pin retracted from the lock pin seat.
Figure 8B:
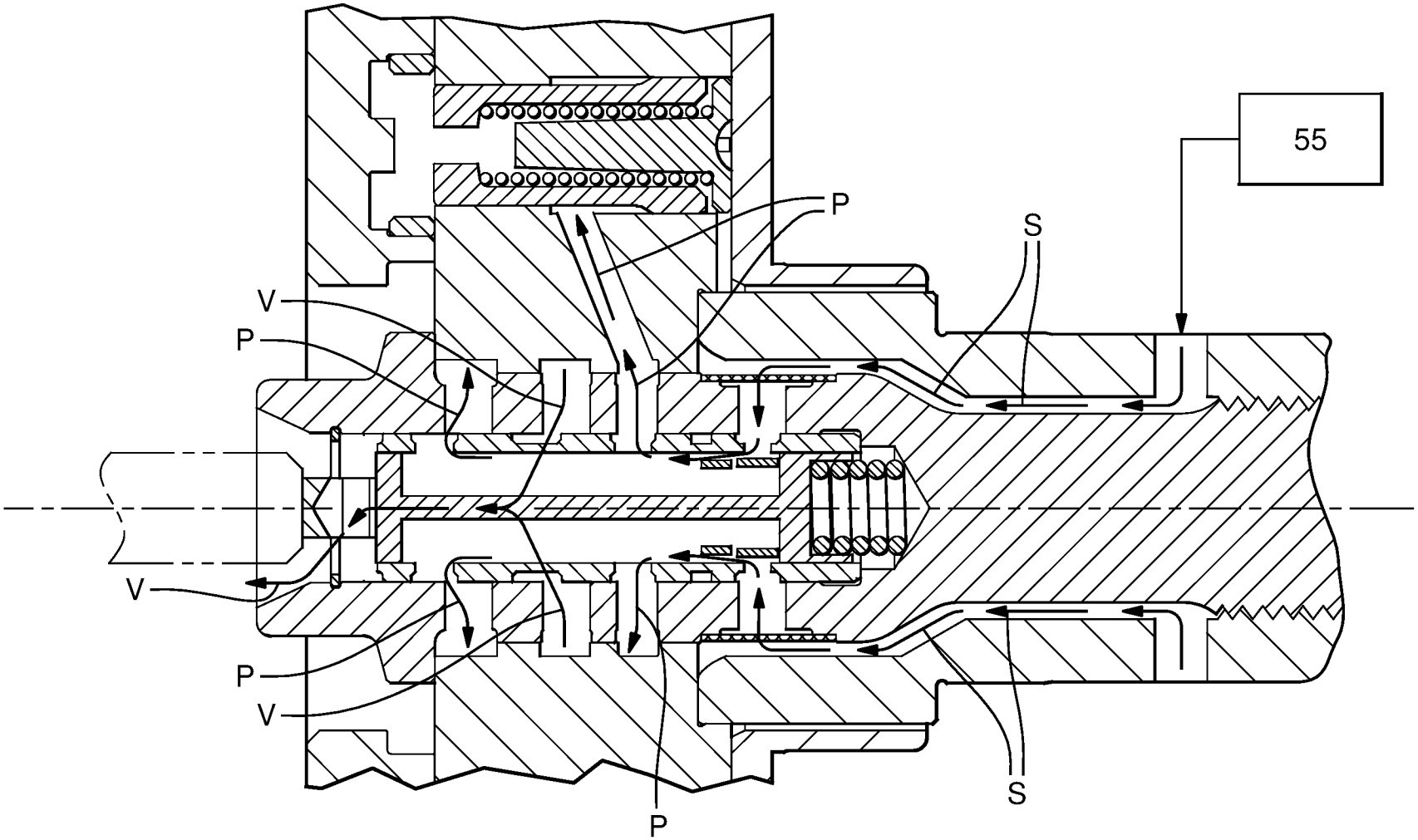
FIG. 8B is the view of FIG. 8A shown with reference numbers removed and arrows added in order to clearly show the path of travel of oil.

In an advance position, when an electric current of a third magnitude is supplied to actuator 102 as shown in FIGS. 8A and 8B, actuator 102 urges valve spool 30 in a direction toward valve spring 104 thereby causing valve spring 104 to be compressed slightly more than in the hold position until valve spool 30 abuts a second stop member 150, which may be, by way of non-limiting example only, a shoulder formed in valve bore 64. In the advance position, supply land 114 is positioned to provide fluid communication between bolt supply passages 74 and spool annular supply groove 116, thereby allowing pressurized oil to be supplied to phasing volume 110 through spool supply passages 118*a*,118*b* and supply check valve 120 from oil source 55. Also in the advance position, lock pin land 122 is positioned to prevent fluid communication between bolt lock pin passages 86 and spool annular lock pin groove 124, thereby preventing oil from being vented from lock pin bore 66. Also in the advance position, lock pin land 122 is positioned to permit fluid communication between bolt lock pin passages 86 and phasing volume 110, thereby allowing pressurized oil to be supplied to lock pin bore 66 via spool advance passage 130, spool annular advance groove 128, bolt lock pin passages 86, bolt annular lock pin groove 84, rotor annular lock pin groove 88, and rotor lock pin passage 72, and as a result, lock pin 26 compresses lock pin spring 70 and lock pin 26 is retracted from lock pin seat 68. Also in the advance position, advance land 131 is positioned to block fluid communication between phasing volume 110 and bolt advance passages 92 while simultaneously permitting fluid communication between bolt advance passages 92 and venting volume 112 via spool annular vent groove 132, and spool vent passage 134. Also in the advance position, retard land 138 is positioned to block fluid communication between bolt retard passages 98 and spool annular vent groove 132 while simultaneously permitting fluid communication between bolt retard passages 98 and phasing volume 110 via spool annular retard groove 140 and spool retard passage 142. In this way, pressurized oil that is supplied to phasing volume 110 from oil source 55 is supplied to retard chambers 44 via spool retard passage 142, spool annular retard groove 140, bolt retard passages 98, bolt annular retard groove 96, rotor annular retard groove 100, and rotor retard passages 58 while oil is simultaneously vented from advance chambers 42 via rotor advance passages 56, rotor annular advance groove 94, bolt advance passages 92, spool annular vent groove 132, spool vent passage 134, venting volume 112, and vent passages 146, thereby causing rotor 20 to rotate relative to stator 18 to cause an advance in timing of camshaft 14 relative to the crankshaft. In FIG. 8B, the reference numbers have been removed for clarity and arrows representing the path of travel of the oil have been included where arrows S represent oil from oil source 55 that is supplied to retard chambers 44 and lock pin bore 66 and arrows V represent vented oil from advance chambers 42. It should be noted that FIG. 8B shows supply check valve 120 being open, but supply check valve 120 may also be closed if a torque reversal acting on camshaft 14 causes the pressure within phasing volume 110 to be greater than the pressure of oil from oil source 55.

Figure 9:
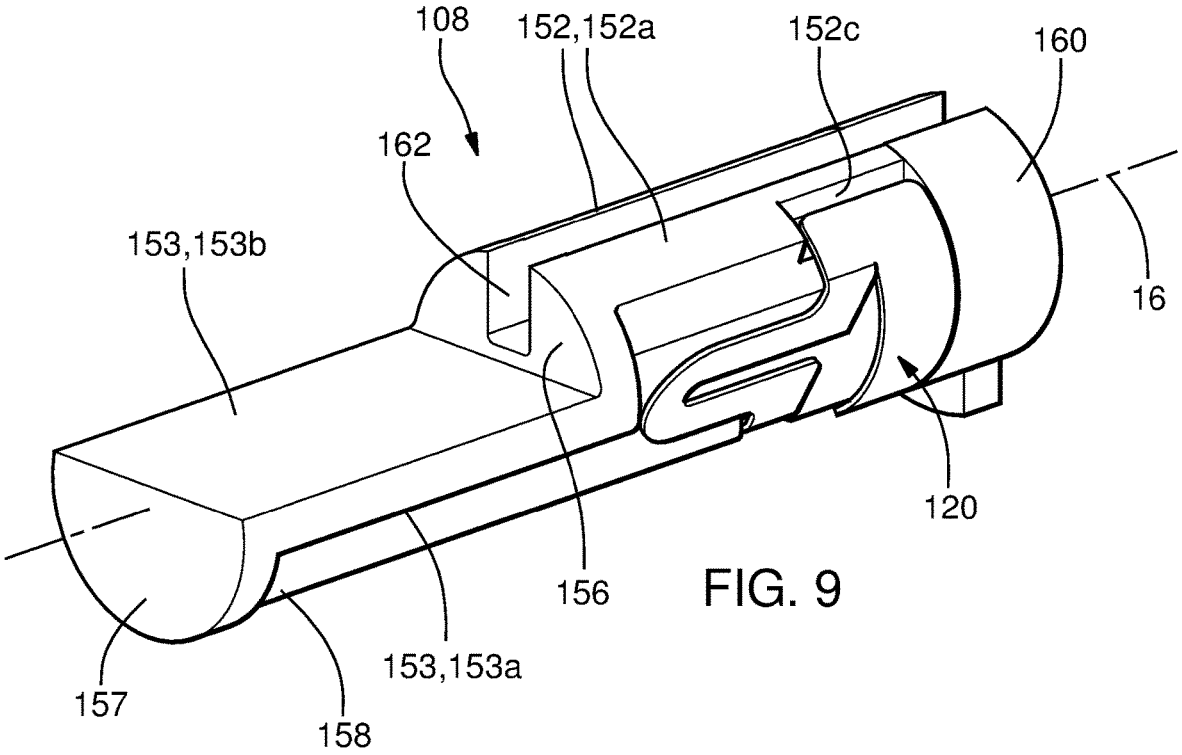
FIGS. 9 and 10 are isometric views of an insert of a valve spool of the camshaft phaser.
Figure 10:
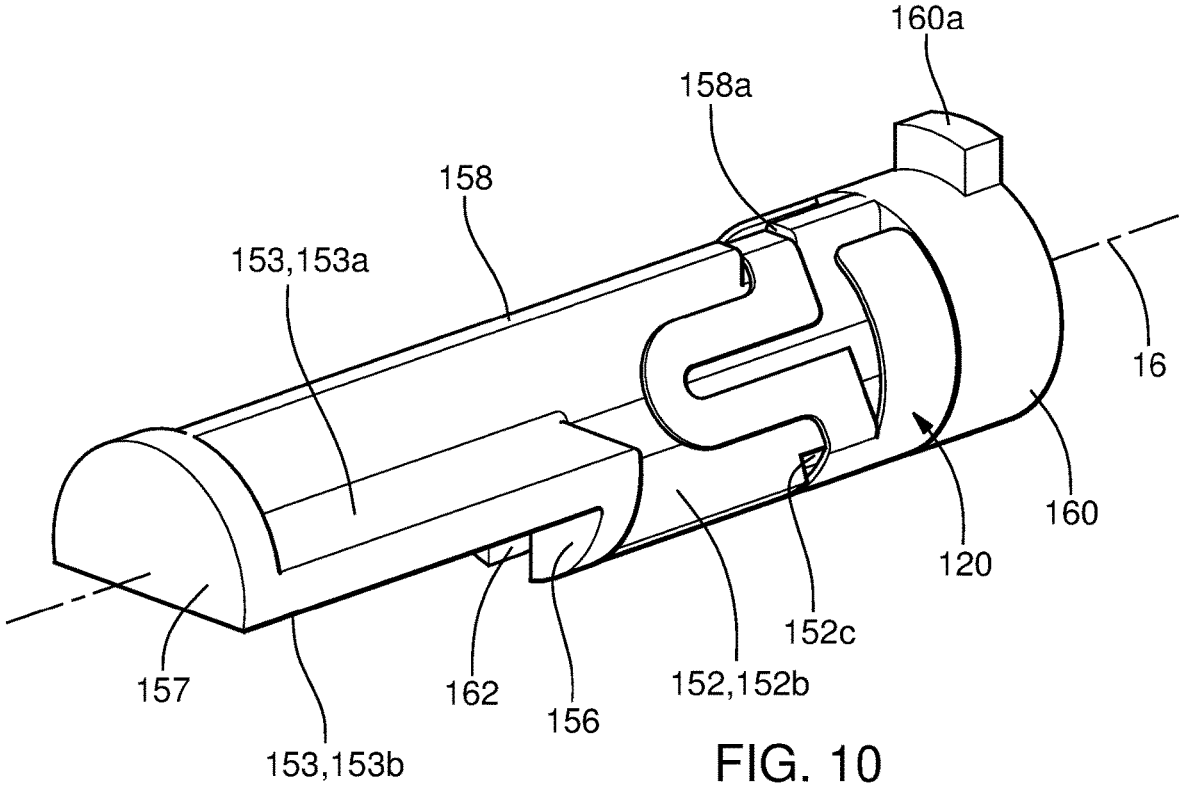
Figure 11:
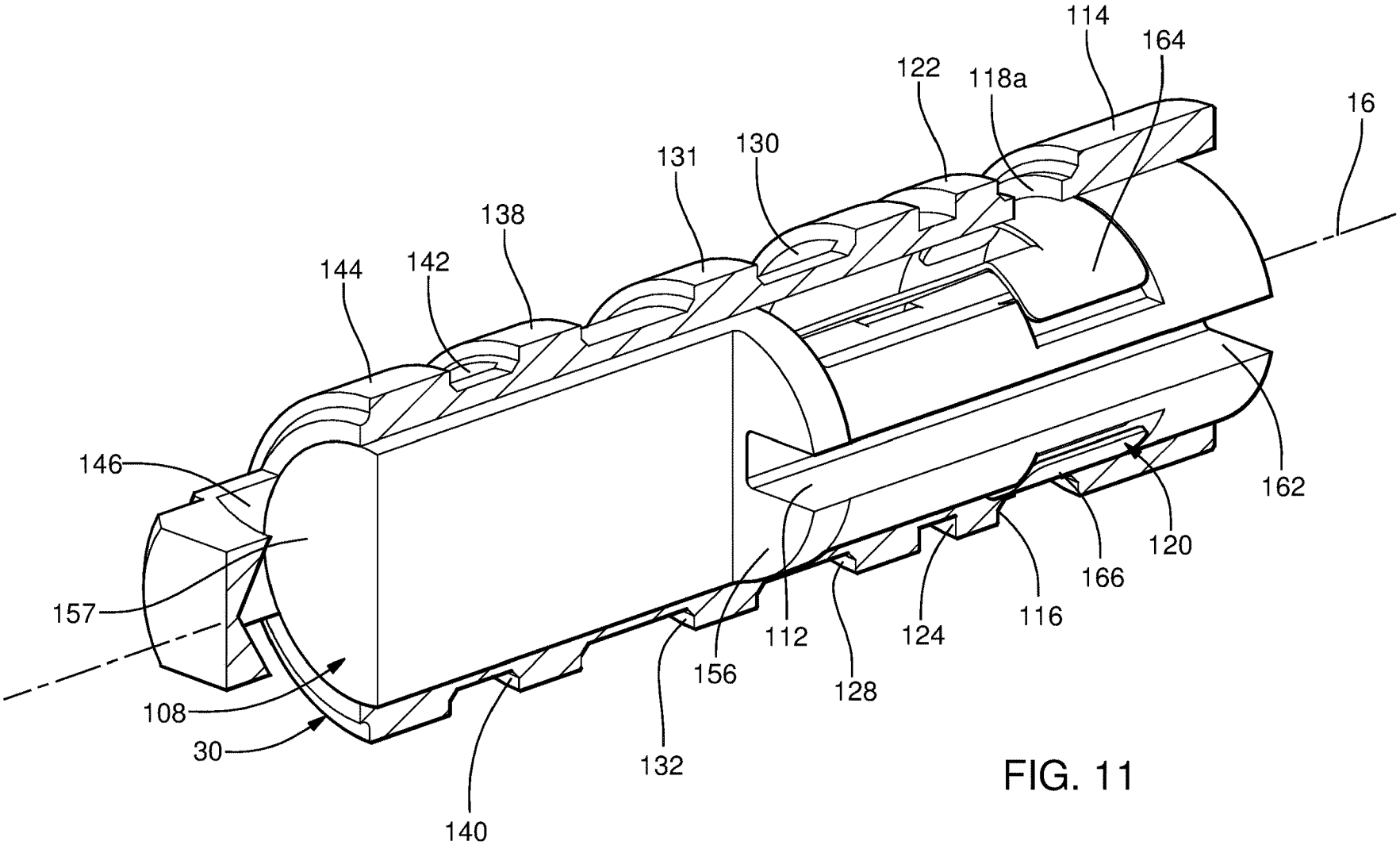
FIGS. 11 and 12 are isometric cross-sectional views of the valve spool and the insert.
Figure 12:
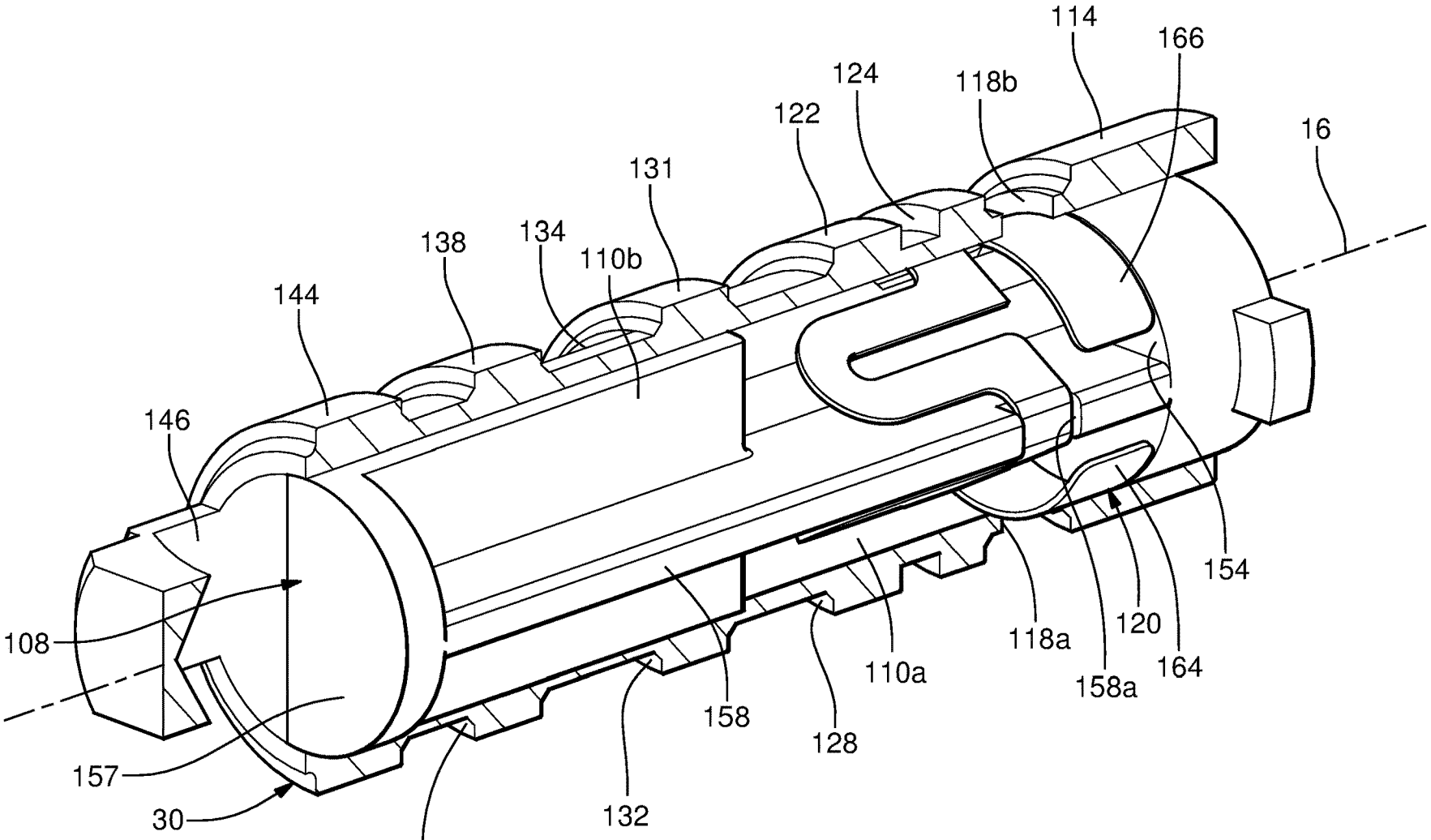

Insert 108 will now be describe with particular reference to FIGS. 9-12 where FIGS. 9 and 10 are isometric views of insert 108 and FIGS. 11 and 12 are isometric axial cross-sectional views of valve spool 30 and insert 108. Insert 108 is defined by an insert first sidewall 152 which extends axially within valve spool bore 106 and is also defined by an insert second sidewall 153 which extends axially within valve spool bore 106 such that insert first sidewall 152 and insert second sidewall 153 occupy distinct axial portions of valve spool bore 106. Insert first sidewall 152 is positioned to a side of valve spool bore 106 such that a first side 152*a* of insert first sidewall 152 faces toward and is contoured to mate sealingly with valve spool bore 106 while a second side 152*b* of insert first sidewall 152 which opposes first side 152*a* defines a portion of phasing volume 110 together with valve spool bore 106. Insert first sidewall 152 includes insert first sidewall recesses 152*c* which extend into second side 152*b* in order to accommodate opening of supply check valve 120 as will be described in greater detail later. Insert second sidewall 153 bifurcates valve spool bore 106 such that a first side 153*a* defines a portion of phasing volume 110 together with valve spool bore 106 and a second side 153*b* which opposes first side 153*a* defines a portion of venting volume 112 together with valve spool bore 106. Insert 108 is also defined by an insert first end wall 154 which traverses valve spool bore 106 in a direction substantially perpendicular to axis of rotation 16 such that insert first end wall 154 is contoured to sealing mate with valve spool bore 106. Insert 108 is also defined by an insert second end wall 156 which joins insert first sidewall 152 to insert second sidewall 153 such that insert second end wall 156 extends axially between insert first sidewall 152 and second sidewall 153 and such that insert first sidewall 152 joins insert first end wall 154 to insert second end wall 156. Insert second end wall 156 is contoured to mate sealingly with valve spool bore 106. Insert 108 is also defined by an insert third end wall 157 which extends from insert second sidewall 153 to valve spool bore 106 such that insert third end wall 157 is contoured to mate sealingly with valve spool bore 106. In this way, a portion of phasing volume 110 is defined axially between insert first end wall 154 and insert second end wall 156 and a portion of phasing volume 110 is defined axially between insert first end wall 154 and insert third end wall 157. Insert 108 may include an insert rib 158 which extends axially from insert first end wall 154 to insert second end wall 156 and from insert first end wall 154 to insert third end wall 157 such that insert rib 158 extends from insert first sidewall 152 toward valve spool bore 106 and from insert second sidewall 153, thereby bifurcating phasing volume 110 into first phasing volume 110*a* and second phasing volume 110*b*. Insert rib 158 provides support to insert first end wall 154, insert second end wall 156, and insert third end wall 157 in order to resist force created during times when phasing volume 110 is exposed to high pressure. Insert rib 158 may also include an insert rib positioning notch 158*a* which positions supply check valve 120 as will be described in greater detail later. Insert rib positioning notch 158*a* extends into the edge of insert rib 158 which faces toward valve spool bore 106 such that insert rib positioning notch 158*a* provides fluid communication between first phasing volume 110*a* and second phasing volume 110*b*, thereby preventing a pressure differential between first phasing volume 110*a* and second phasing volume 110*b*. An insert spring wall 160 extends axially from insert first end wall 154 in a direction that is opposite of insert first sidewall 152 such that insert spring wall 160 is hollow in order to receive a portion of valve spring 104 therein. In this way, one end of valve spring 104 mates with insert first end wall 154 and is maintained in a centered relationship about axis of rotation 16 by insert spring wall 160. In order to provide proper orientation of insert 108 within valve spool bore 106, insert spring wall 160 may include an alignment tab 160*a* which is received within a complementary spool alignment notch (not shown) in valve spool 30. An insert slot 162 extends axially along insert 108 such that insert slot 162 extends along insert spring wall 160, insert first end wall 154, first side 152*a* of insert first sidewall 152, and insert second end wall 156. In this way, a portion of venting volume 112 is defined between insert slot 162 and valve spool bore 106 while, as described previously, a portion of venting volume 112 is defined between insert second sidewall 153 and valve spool bore 106. It should be noted that since insert second sidewall 153 bifurcates valve spool bore 106, the portions of phasing volume 110 and venting volume 112 have substantially the same cross-sectional areas when sectioned by a plane that is perpendicular to axis of rotation 16. As used herein, the cross-sectional areas of phasing volume 110 and venting volume 112 may differ by about 10% or less while still being considered to be substantially the same. It should also be noted that spool supply passages 118*a*,118*b* are aligned along axis of rotation 16 with the portion of phasing volume 110 that is defined by insert first sidewall 152, that spool advance passage 130 is aligned along axis of rotation 16 with the portion of phasing volume 110 that is defined by insert first sidewall 152, that spool vent passage 134 is aligned along axis of rotation 16 with the portion of venting volume 112 that is defined by insert second sidewall 153, and that spool retard passage 142 is aligned along axis of rotation 16 with the portion of venting volume 112 that is defined by insert second sidewall 153.

Figure 13:
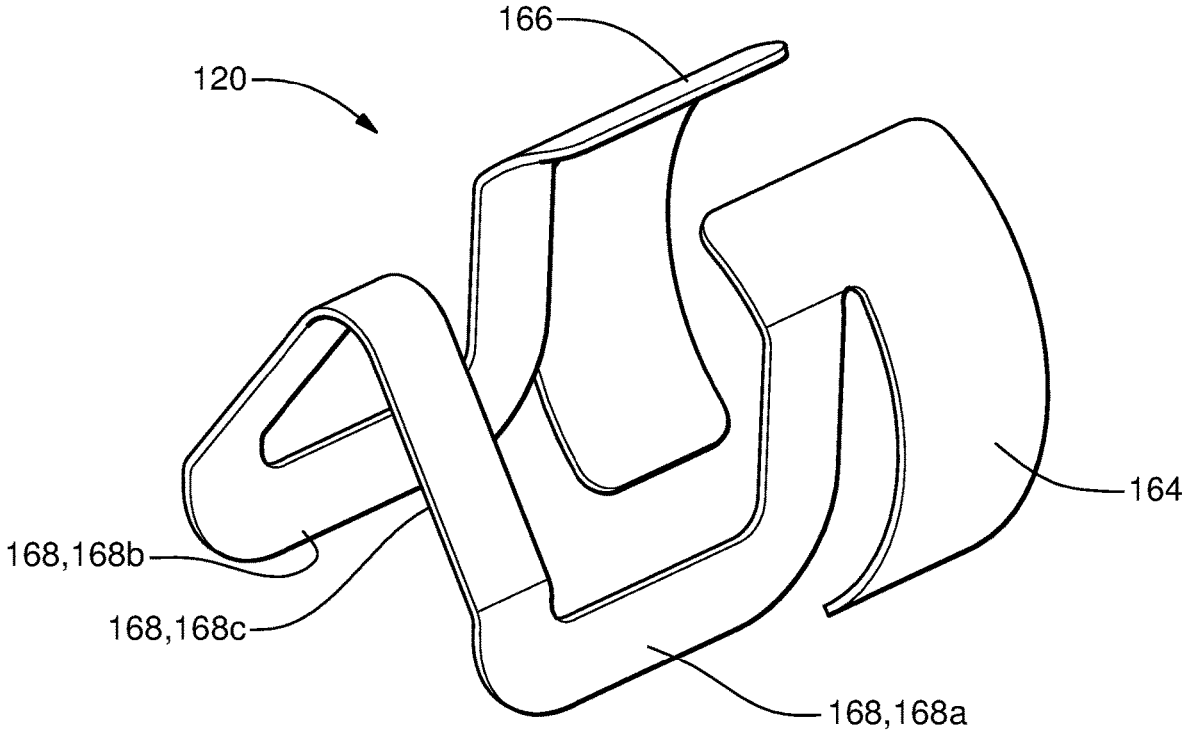
FIG. 13 is an isometric view of a supply check valve of the camshaft phaser.
Figure 14:
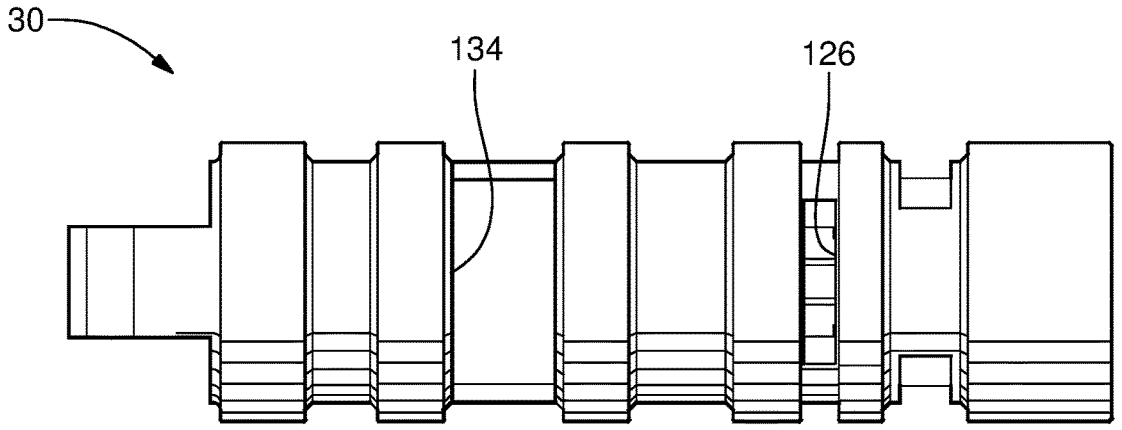
FIG. 14 is an elevation view of the valve spool.
Figure 15:
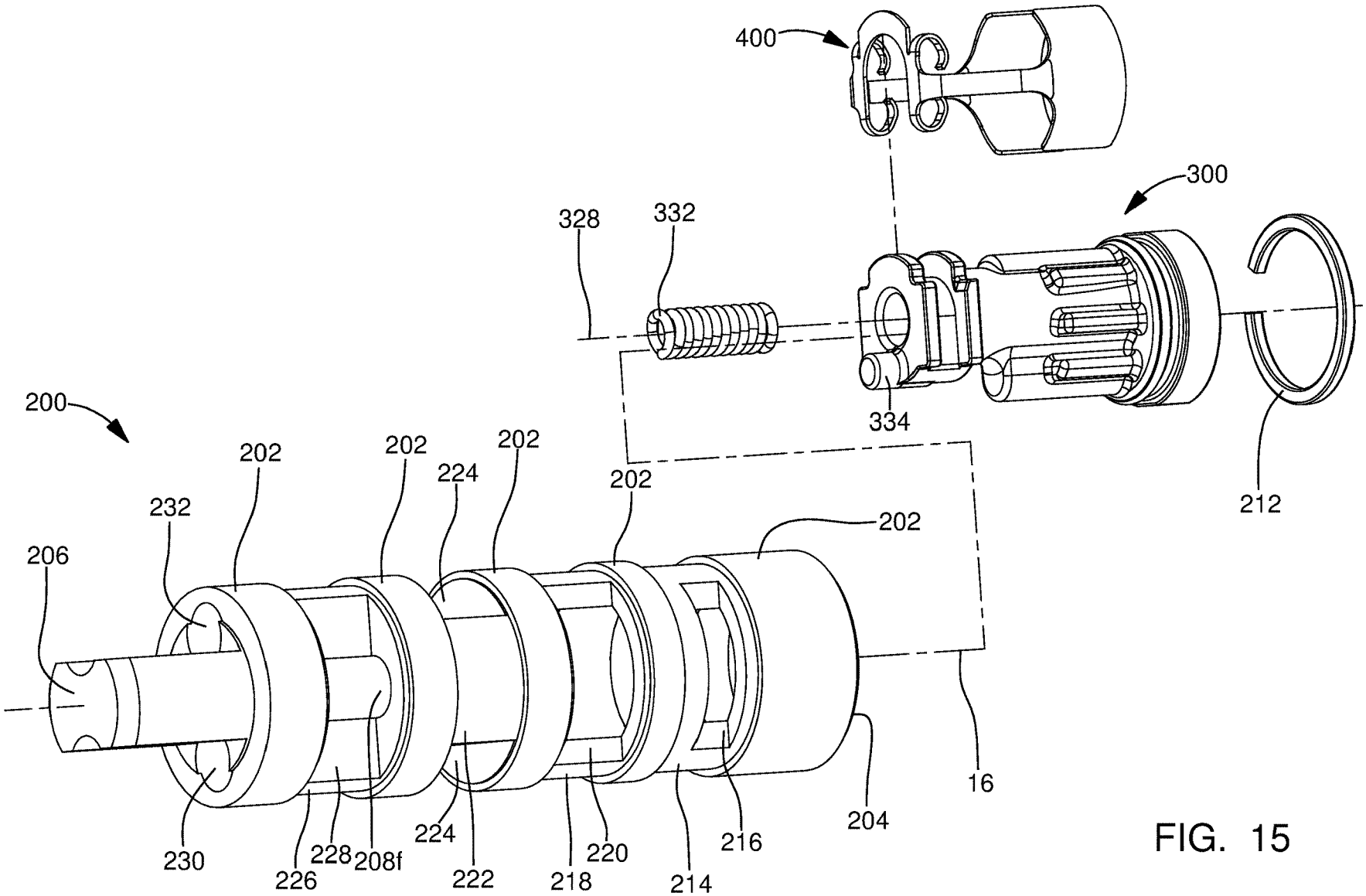
FIG. 15 is an exploded isometric view of a valve spool, an insert, and a check valve in accordance with the present invention for use in the camshaft phaser of FIG. 1.
Figure 16:
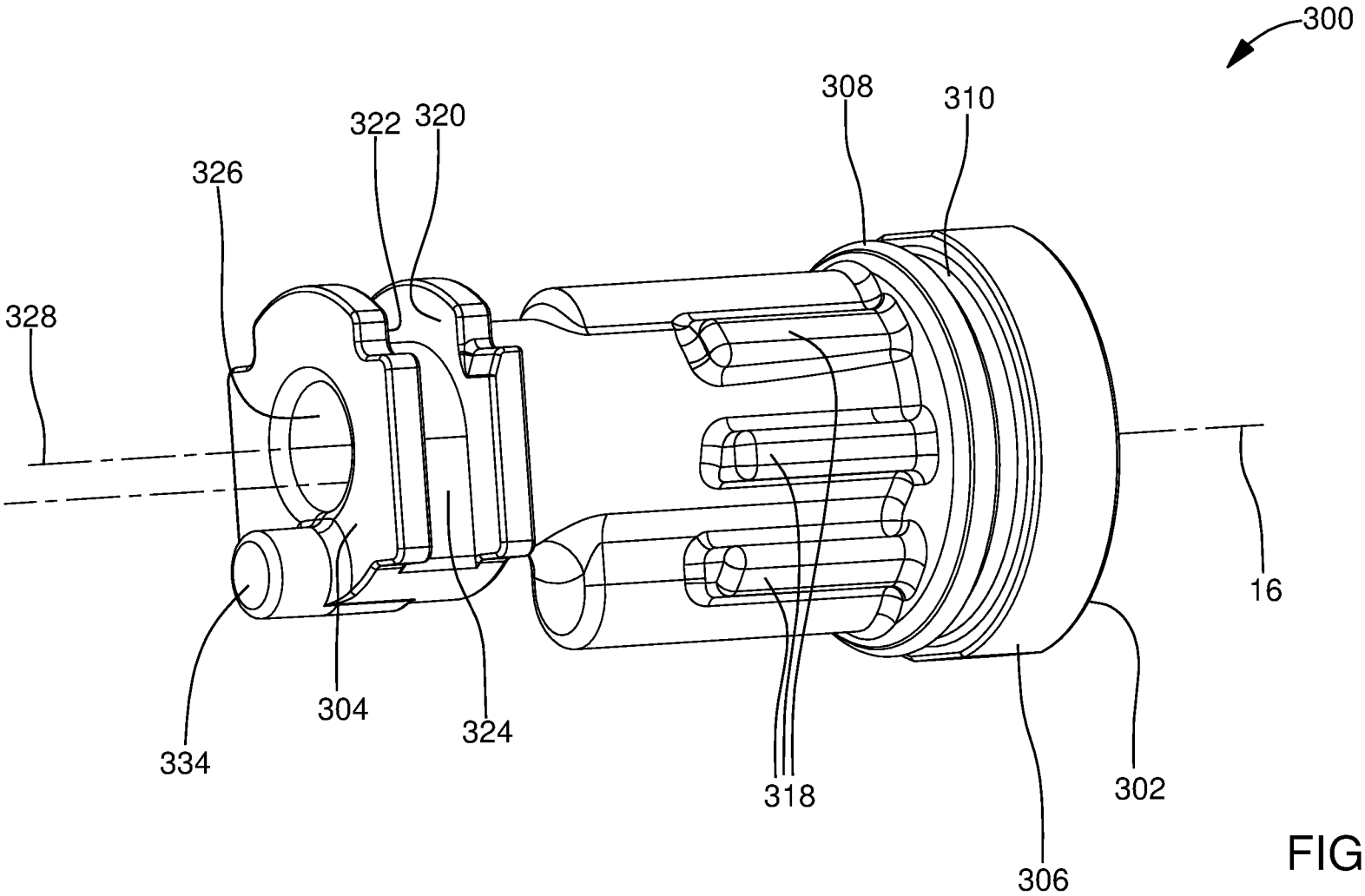
FIG. 16 is an isometric view of the insert of FIG. 15.
Figure 17:
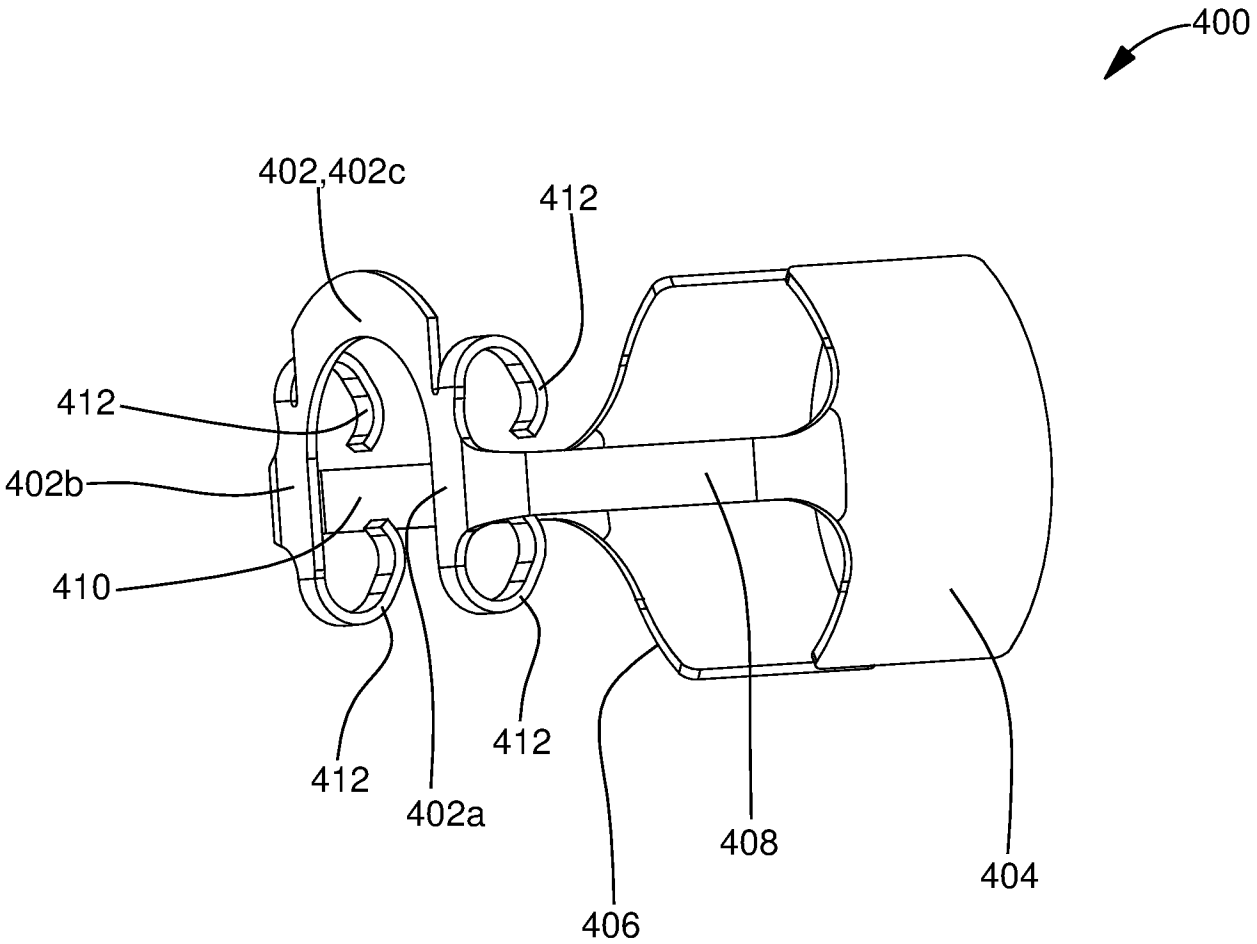
FIG. 17 is an isometric view of the check valve of FIG. 15.
Figure 18:
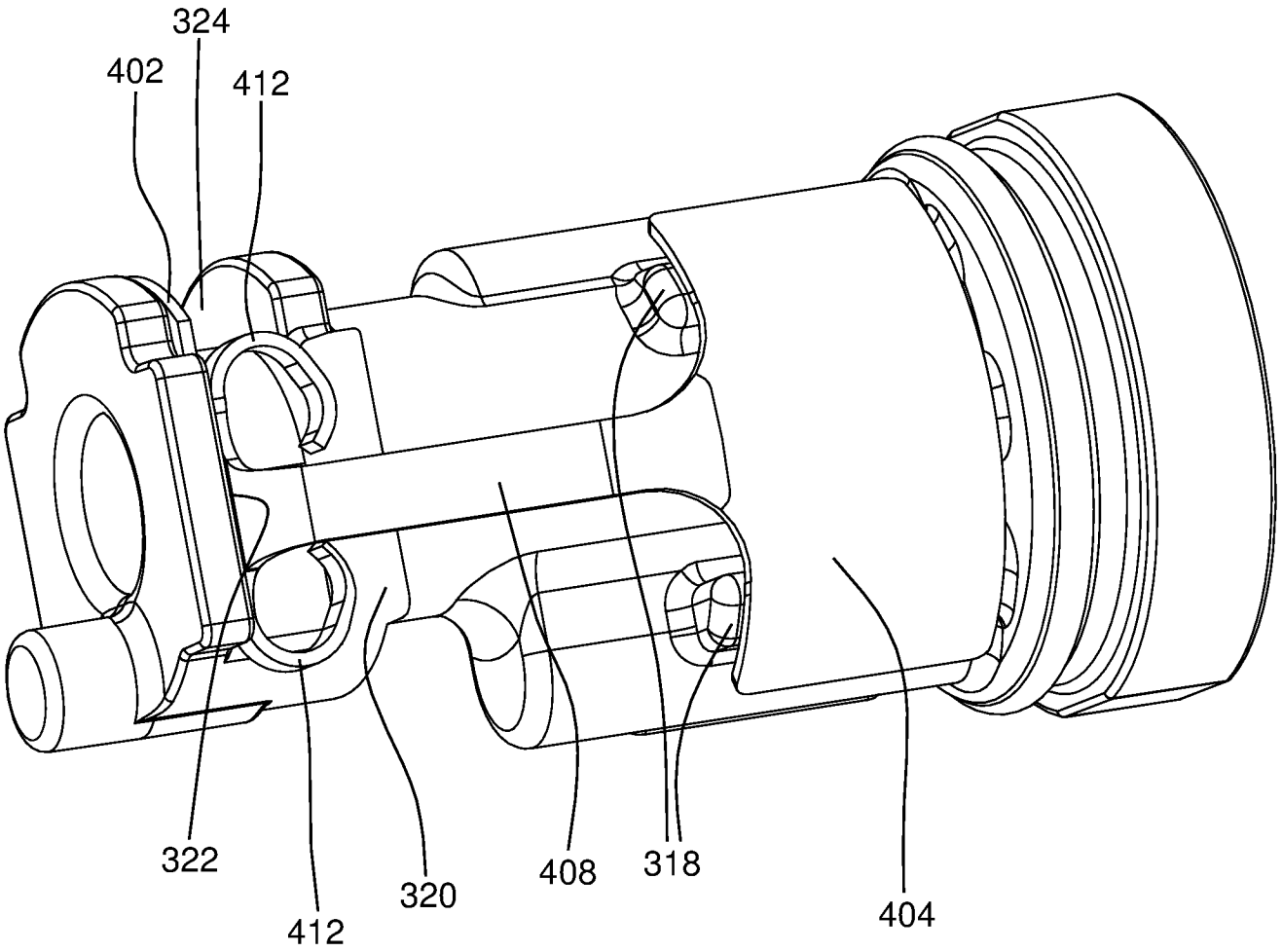
FIG. 18 is an isometric view of the check valve of FIG. 15 assembled to the insert.
Figure 19:
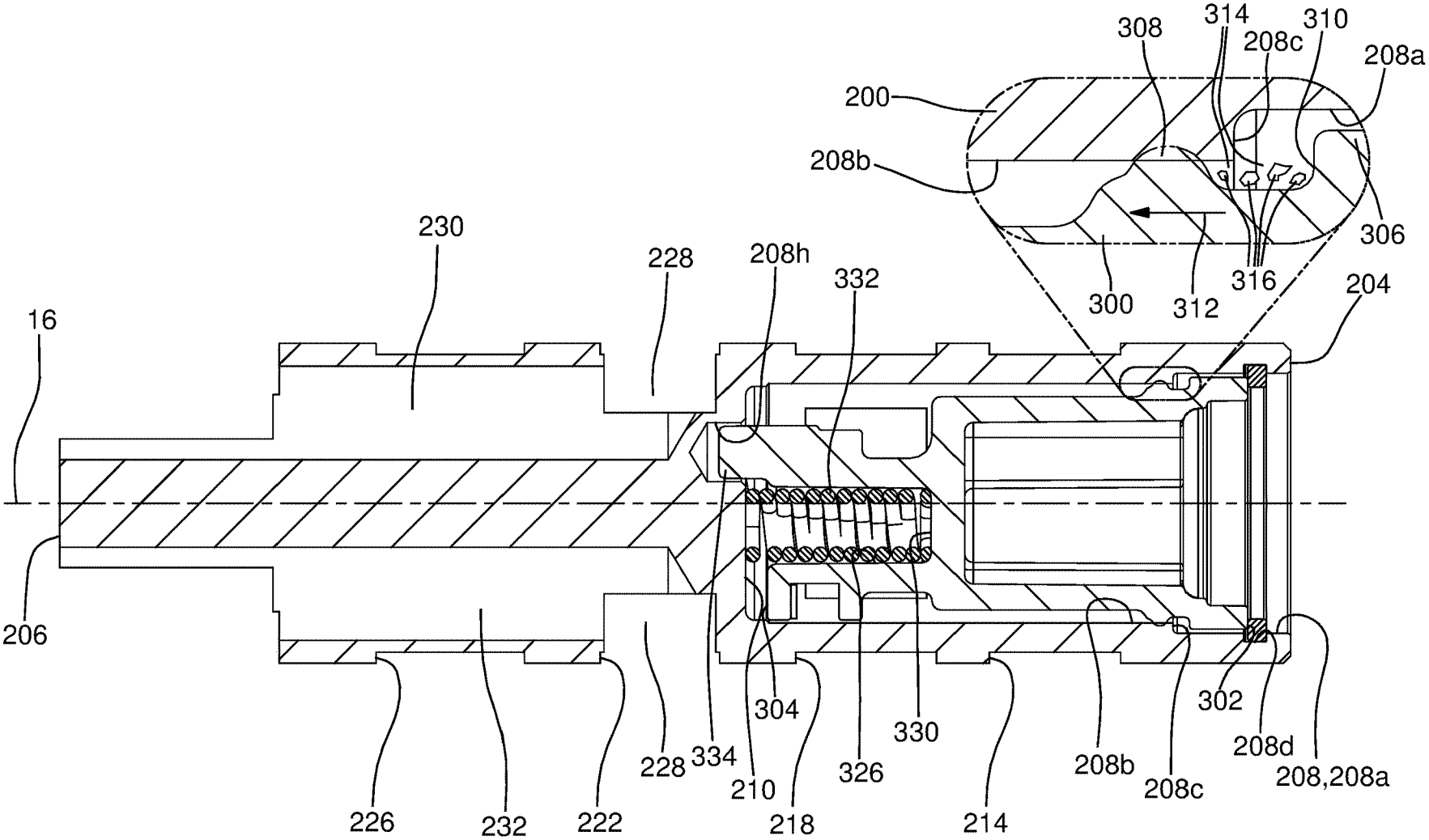
FIG. 19 is an axial cross-sectional view of the valve spool, the insert, and the check valve of FIG. 15.

Supply check valve 120 will now be described with particular reference to FIG. 13. Supply check valve 120 includes a first check valve member 164 and a second check valve member 166 such that first check valve member 164 is located within first phasing volume 110*a* and second check valve member 166 is located within second phasing volume 110*b* and such that first check valve member 164 is diametrically opposed to second check valve member 166 within valve spool bore 106. First check valve member 164 and second check valve member 166 are each arcuate in shape in order to match the curvature of valve spool bore 106 and are sized to selectively block respective spool supply passages 118*a*, 118*b*. Supply check valve 120 also includes a biasing section 168 which joins first check valve member 164 and second check valve member 166. Biasing section 168 is resilient and compliant in order to bias first check valve member 164 and second check valve member 166 into contact with valve spool bore 106 while allowing first check valve member 164 and second check valve member 166 to be displaced inward under operating conditions as described previously which require flow into phasing volume 110 through spool supply passages 118*a*, 118*b*. Biasing section 168 includes a biasing section first leg 168*a* which extends axially from first check valve member 164 within first phasing volume 110*a*, a biasing section second leg 168*b* which extends axially from second check valve member 166 within second phasing volume 110*b*, and a biasing section bridge 168*c* which joins biasing section first leg 168*a* and biasing section second leg 168*b* such that biasing section bridge 168*c* is axially spaced from first check valve member 164 and from second check valve member 166. Biasing section bridge 168*c* passes between first phasing volume 110*a* and second phasing volume 110*b* through insert rib positioning notch 158*a*. Biasing section bridge 168*c* and insert rib positioning notch 158*a* are sized to maintain the axial position of supply check valve 120 within phasing volume 110 to ensure that first check valve member 164 and second check valve member 166 are properly positioned to block respective spool supply passages 118*a*, 118*b* when first check valve member 164 and second check valve member 166 are biased into contact with valve spool bore 106. It should be noted that when first check valve member 164 and second check valve member 166 are opened by oil pressure, first check valve member 164 and second check valve member 166 are each received within a respective insert first sidewall recess 152*c*. As shown, supply check valve 120 may be a simple one-piece device that is made of formed sheet metal.

Figure 2:
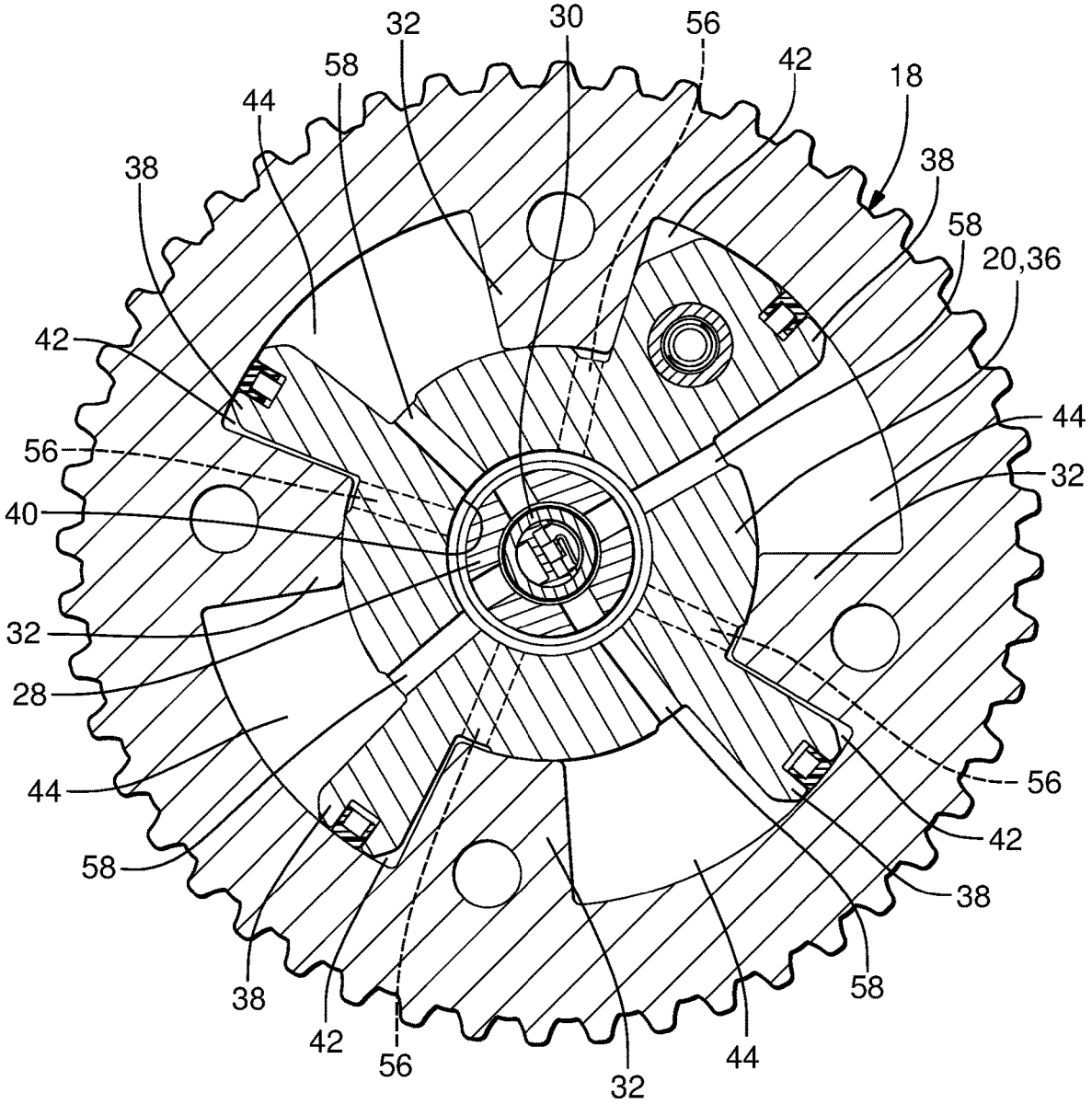
FIG. 2 is a radial cross-sectional view of the camshaft phaser of FIG. 1.
Figure 3:
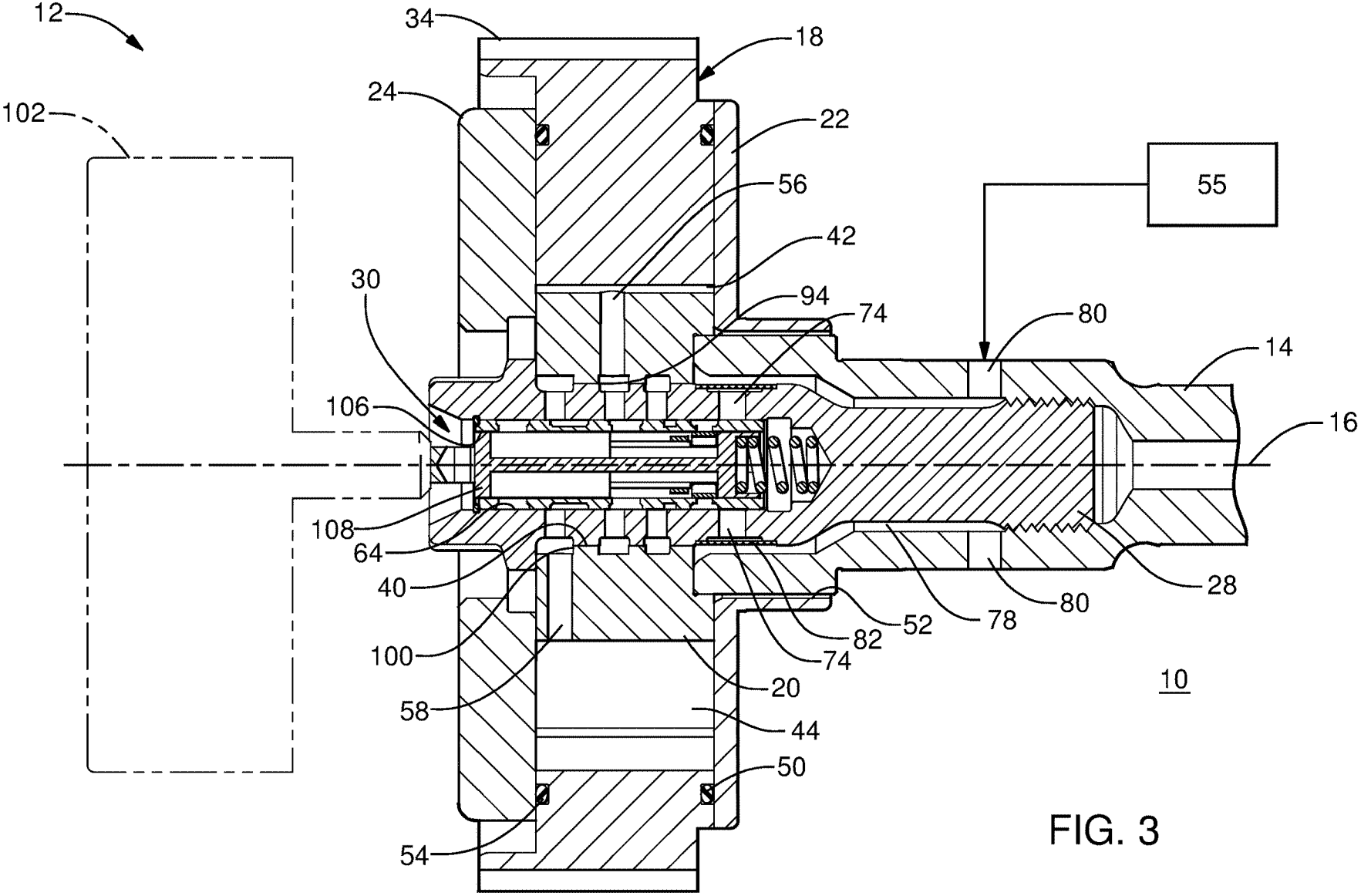
FIG. 3. is a cross-sectional view of the camshaft phaser of FIG. 1 taken through advance and retard passages of a rotor of the camshaft phaser.
Figure 4:
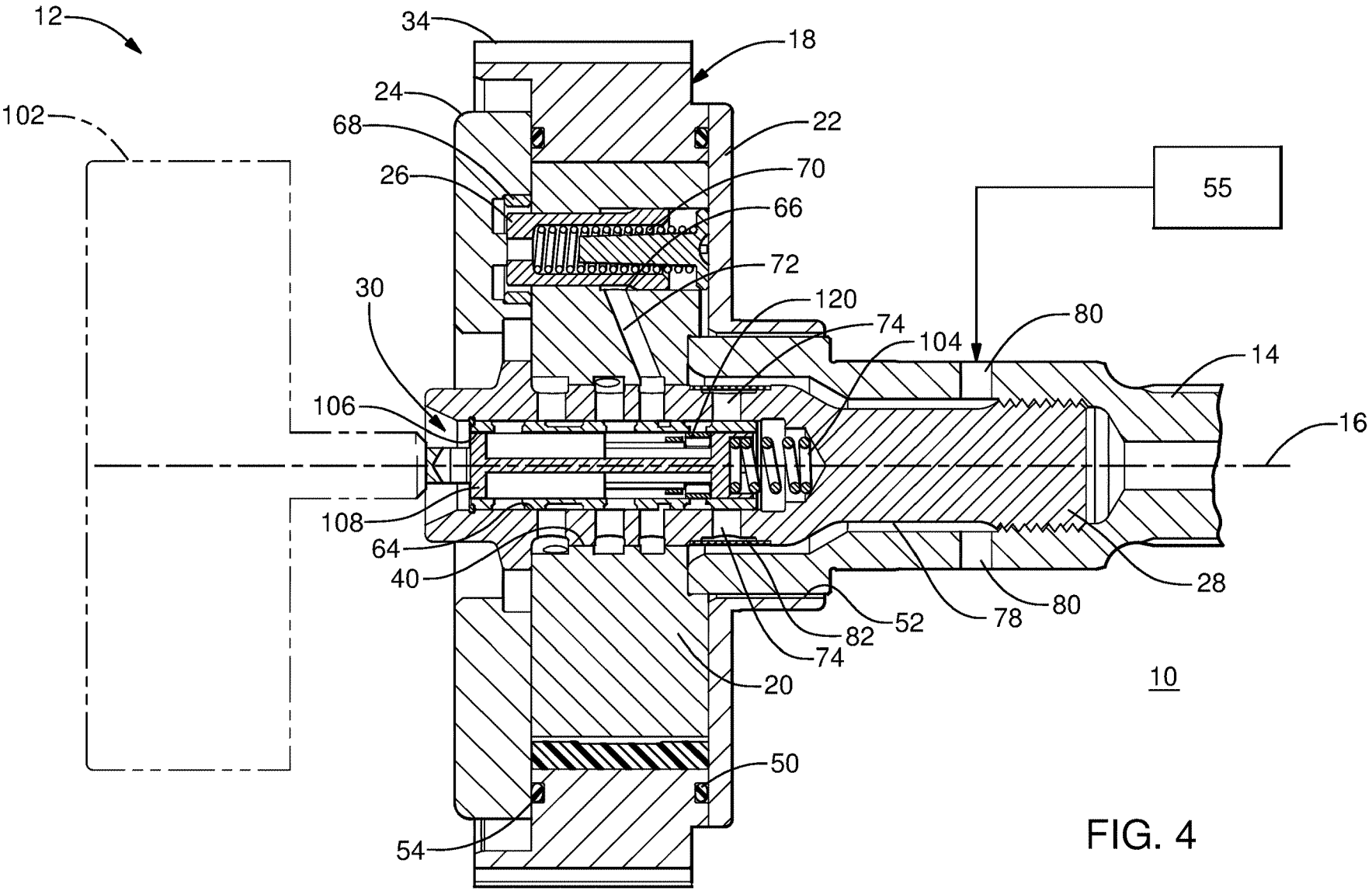
FIG. 4. is a cross-sectional view of the camshaft phaser of FIG. 1 taken through a lock pin of the camshaft phaser.

While camshaft phaser 12 has been described as defaulting to full advance, it should now be understood that camshaft phaser 12 may alternatively default to full retard by simply rearranging oil passages. Similarly, while full advance has been described as full counterclockwise rotation of rotor 20 within stator 18 as shown in FIG. 2, it should also now be understood that full advance may alternatively be full clockwise rotation of rotor 20 within stator 18 depending on whether camshaft phaser 12 is mounted to the front of internal combustion engine 10 (shown in the figures) or to the rear of internal combustion engine 10.

While camshaft phaser attachment bolt 28 has been described herein as including grooves on the outer periphery thereof which are aligned with corresponding grooves formed in rotor central through bore 40 of rotor 20, it should now be understood that the grooves on camshaft phaser attachment bolt 28 could be omitted and the grooves formed in rotor central through bore 40 could be used to serve the same function. Similarly, the grooves formed in rotor central through bore 40 could be omitted and the grooves on camshaft phaser attachment bolt 28 could be used to serve the same function.

Now with reference to FIGS. 15-20, an alternative valve spool 200, insert 300, and check valve 400 is illustrated in accordance with the present invention where valve spool 200 replaces valve spool 30, insert 300 replaces insert 108, and check valve 400 replaces supply check valve 120. Valve spool 200, insert 300, and check valve 400 will be described in greater detail in the paragraphs that follow.

Valve spool 200 includes an outer peripheral surface 202 which is cylindrical and centered about axis of rotation 16 and which is sized to interface with valve bore 64 of camshaft phaser attachment bolt 28 is a close sliding fit which allows valve spool 200 to move axially within valve bore 64 of camshaft phaser attachment bolt 28 while substantially preventing oil from passing between the interface of outer peripheral surface 202 and valve bore 64. Valve spool 200 extends from a valve spool first end 204 which is proximal to camshaft 14 to a valve spool second end 206 which is proximal to actuator 102.

A valve spool bore 208 extends into valve spool 200 from valve spool first end 204 toward valve spool second end 206 such that valve spool bore 208 is centered about, and extends along, axis of rotation 16. Valve spool bore 208 extends to a valve spool bore floor 210 which is traverse to axis of rotation 16. Valve spool bore 208 includes a valve spool bore first portion 208*a* which extends from valve spool first end 204 toward valve spool second end 206 and also includes a valve spool bore second portion 208*b* which extends from valve spool bore first portion 208*a* to valve spool bore floor 210. Valve spool bore second portion 208*b* is smaller in diameter than valve spool bore first portion 208*a*, thereby defining a valve spool bore shoulder 208*c* where valve spool bore second portion 208*b* meets valve spool bore first portion 208*a* such that valve spool bore shoulder 208*c* faces toward valve spool first end 204. A valve spool bore retention groove 208*d* extends radially outward from valve spool bore first portion 208*a* such that valve spool bore retention groove 208*d* is annular in shape and such that valve spool bore retention groove 208*d* receives an insert retainer 212 therein for retaining insert 300 within valve spool bore 208 as will be described in greater detail later. Insert retainer 212 is a split ring which is resilient and compliant, thereby allowing insert retainer 212 to be resiliently deflected to be decreased in diameter for insertion into valve spool bore first portion 208*a* and then spring outward when aligned with valve spool bore retention groove 208*d*. A valve spool first auxiliary bore 208*f* and a valve spool second auxiliary bore 208*g* each extend from valve spool bore floor 210 toward valve spool second end 206 such that valve spool first auxiliary bore 208*f* and valve spool second auxiliary bore 208*g* are each in constant fluid communication with valve spool bore 208. Valve spool first auxiliary bore 208*f* and valve spool second auxiliary bore 208*g* are each laterally offset from, and parallel to, axis of rotation 16 such that valve spool first auxiliary bore 208*f* and valve spool second auxiliary bore 208*g* are diametrically opposed to each other and such that axis of rotation 16 does not pass through either of valve spool first auxiliary bore 208*f* and valve spool second auxiliary bore 208*g*. Finally, a valve spool bore insert clocking bore 208*h* extends from valve spool bore floor 210 toward valve spool second end 206 such that valve spool bore insert clocking bore 208*h* is laterally offset from axis of rotation 16 and such that valve spool bore insert clocking bore 208*h* is used to orient insert 300 about axis of rotation 16 within valve spool bore 208 as will be describe in greater detail later.

Valve spool 200 includes a valve spool supply groove 214 which is annular and which extends radially into outer peripheral surface 202 such that valve spool supply groove 214 is selectively aligned with bolt supply passages 74 of camshaft phaser attachment bolt 28. A pair of spool supply passages 216 provide fluid communication between valve spool supply groove 214 and valve spool bore 208. Spool supply passages 216 each extend inward from valve spool supply groove 214 to valve spool bore second portion 208*b* and each take the form of a sector of an annulus such that spool supply passages 216 are diametrically opposed to each other. Valve spool 200 also includes a valve spool advance groove 218 which is annular in shape and which extends radially into outer peripheral surface 202 such that valve spool advance groove 218 is selectively aligned with bolt advance passages 92 to supply oil to advance chambers 42 and such that valve spool advance groove 218 is axially spaced apart from valve spool supply groove 214 by outer peripheral surface 202. A pair of spool advance passages 220 provide fluid communication between valve spool advance groove 218 and valve spool bore second portion 208*b* and each take the form of a sector of an annulus such that spool advance passages 220 are diametrically opposed to each other. Valve spool 200 also includes a valve spool vent groove 222 which is annular in shape and which extends radially into outer peripheral surface 202 such that valve spool vent groove 222 is selectively aligned with bolt advance passages 92 in order to vent oil from advance chambers 42 or is selectively aligned with bolt retard passages 98 in order to selectively vent oil from retard chambers 44. Valve spool vent groove 222 is axially spaced apart from valve spool advance groove 218 by outer peripheral surface 202. A pair of spool vent passages 224 extend inward from valve spool vent groove 222 toward axis of rotation 16 in order to provide a vent path as will be described in greater detail later and such that spool vent passages 224 are diametrically opposed to each other. Valve spool 200 also includes a valve spool retard groove 226 which is annular in shape and which extends radially into outer peripheral surface 202 such that valve spool retard groove 226 is selectively aligned with bolt retard passages 98 to supply oil to retard chambers 44 and such that valve spool retard groove 226 is axially spaced apart from valve spool vent groove 222 by outer peripheral surface 202. A pair of spool retard passages 228 provide fluid communication between valve spool advance groove 218 and valve spool first auxiliary bore 208*f* and between valve spool advance groove 218 and valve spool second auxiliary bore 208*g* such that spool retard passages 228 are diametrically opposed to each other. Valve spool 200 also includes a valve spool first vent bore 230 and a valve spool second vent bore 232 which each extend from valve spool second end 206 and intersect with respective spool vent passages 224 such that valve spool first vent bore 230 and valve spool second vent bore 232 provide a path for oil to be vented to valve bore 64 and out of camshaft phaser 12. Valve spool first vent bore 230 and valve spool second vent bore 232 are each parallel to, and laterally offset from, axis of rotation 16 such that axis of rotation 16 does not pass through either of valve spool first vent bore 230 and a valve spool second vent bore 232. It should be noted that the collection of valve spool vent groove 222, spool vent passages 224, valve spool first vent bore 230 and valve spool second vent bore 232 is fluidly segregated from the collection of valve spool bore second portion 208*b*, valve spool first auxiliary bore 208*f*, and valve spool second auxiliary bore 208*g*.

Insert 300 extends from an insert first end 302, which is proximal to valve spool first end 204 and which axially abuts insert retainer 212, to an insert second end 304, which is proximal to valve spool bore floor 210. Insert 300 includes an insert first portion 306 at insert first end 302 which has an outer periphery which is sized to fit within valve spool bore first portion 208*a* and which is sized to fit axially between valve spool bore shoulder 208*c* and insert retainer 212 such that insert first portion 306 is centered about axis of rotation 16. Insert 300 also includes an insert sealing bead 308 which is located within valve spool bore second portion 208*b* axially between spool supply passages 216 and valve spool bore shoulder 208*c*. Insert sealing bead 308 is annular in shape, centered about axis of rotation 16, and is smaller in diameter than insert first portion 306. Insert sealing bead 308 is spaced axially apart from insert first portion 306 by an insert groove 310 which is annular, centered about axis of rotation 16, and smaller in diameter than insert sealing bead 308. Insert sealing bead 308 is sized such that when insert sealing bead 308 is inserted into valve spool bore second portion 208*b* in a direction from valve spool first end 204 toward valve spool second end 206, the direction being illustrated by arrow 312 in FIG. 19, the outer periphery of insert sealing bead 308 is sheared off. The material of the outer periphery of insert sealing bead 308 that is sheared off is deposited in an annular chamber 314 that is formed radially between insert groove 310 and valve spool bore 208 where the portion of insert sealing bead 308 that is sheared off by insertion is illustrated by reference number 316 in FIG. 19. By allowing this material of insert sealing bead 308 to be sheared off, sealing engagement radially between insert sealing bead 308 and valve spool bore 208 is ensured by eliminating the potential for manufacturing variations to produce a gap, i.e. minimum material conditions, which would allow leakage. After the material has been sheared off of insert sealing bead 308, insert sealing bead 308 is in sealing engagement with valve spool bore second portion 208*b*, and in this way, insert 300 sealingly closes one end of valve spool bore 208. It should be noted that the portion of insert sealing bead 308 that is to be sheared off is illustrated in phantom lines in the enlarged portion of FIG. 19 and is shown in solid lines in the remainder of FIG. 19 and in FIG. 20 to show its initial condition.

The portion of insert 300 which is axially between insert sealing bead 308 and insert second end 304 is sized to accommodate and support check valve 400 radially between insert 300 and valve spool bore second portion 208*b* and includes a plurality of insert check valve travel limiters 318 which extend radially outward therefrom and are aligned with spool supply passages 216. The function of insert check valve travel limiters 318 will be described in greater detail later. The portion of insert 300 which is axially between insert sealing bead 308 and insert second end 304 includes an insert first surface 320 which is traverse to axis of rotation 16 and also includes an insert second surface 322 which is traverse to axis of rotation 16 and faces toward insert first surface 320, thereby defining an insert retention channel 324 axially between insert first surface 320 and insert second surface 322 which may be U-shaped as illustrated in the figures. Insert retention channel 324 is used to position and support check valve 400 as will be described in greater detail later.

An insert spring bore 326 extends into insert 300 from insert second end 304 in a direction which is parallel to axis of rotation 16. Insert spring bore 326 is centered about an insert spring bore axis 328 which is parallel to, and laterally offset from, axis of rotation 16, however, axis of rotation 16 does pass through insert spring bore 326. Insert spring bore 326 is truncated by an insert spring bore end wall 330 which traverses insert spring bore axis 328. An insert spring 332 is located within insert spring bore 326 and is held in compression against insert spring bore end wall 330 and valve spool bore floor 210. In this way, insert spring 332 urges insert 300 toward, and holds insert 300 in compression against, insert retainer 212. Insert spring 332 is selected to provide sufficient force to maintain insert 300 in compression against insert retainer 212 under all operating conditions of camshaft phaser 12. A person of ordinary skill in the art would be able to select insert spring 332 to provide such sufficient force to maintain insert 300 in compression against insert retainer 212 through empirical testing, simulation, or calculations based on the pressure/vacuum/pulsation conditions that would be encountered within valve spool bore second portion 208*b* during operation which would tend to cause insert 300 to separate from insert retainer 212 if left unopposed.

Insert 300 also includes an insert alignment pin 334 which extends from insert second end 304 into valve spool bore insert clocking bore 208*h*. Insert alignment pin 334 is eccentric to axis of rotation 16, and consequently, insert alignment pin 334 orients insert 300 within valve spool bore 208 and prevents rotation of insert 300 within valve spool bore 208 about axis of rotation 16.

Check valve 400 is made of a single piece of sheet metal which is stamped and formed to include the features which will now be described. Check valve 400 is carried by insert 300 and includes a check valve base 402 which is U-shaped and received within insert retention channel 324. Check valve base 402 includes a first leg 402*a*, a second leg 402*b* spaced laterally from first leg 402*a*, and a bridge 402*c* which joins one end of first leg 402*a* with one leg of second leg 402*b*. Check valve 400 also includes a first check valve member 404 and a second check valve member 406 which are diametrically opposed to each other and contoured to be complementary to valve spool bore second portion 208*b*. First check valve member 404 and second check valve member 406 are each aligned with a respective spool supply passage 216 and are sized to selectively block spool supply passages 216, thereby preventing oil from flowing out of valve spool bore 208 through spool supply passages 216. First check valve member 404 is connected to first leg 402*a* by a first arm 408 which is resilient and compliant such that first arm 408 biases first check valve member 404 into a seated position against valve spool 200, thereby blocking a respective spool supply passage 216. Similarly, second check valve member 406 is connected to second leg 402*b* by a second arm 410 which his resilient and compliant such that second arm 410 biases second check valve member 406 into a seated position against valve spool 200, thereby blocking a respective spool supply passage 216.

Figure 20:
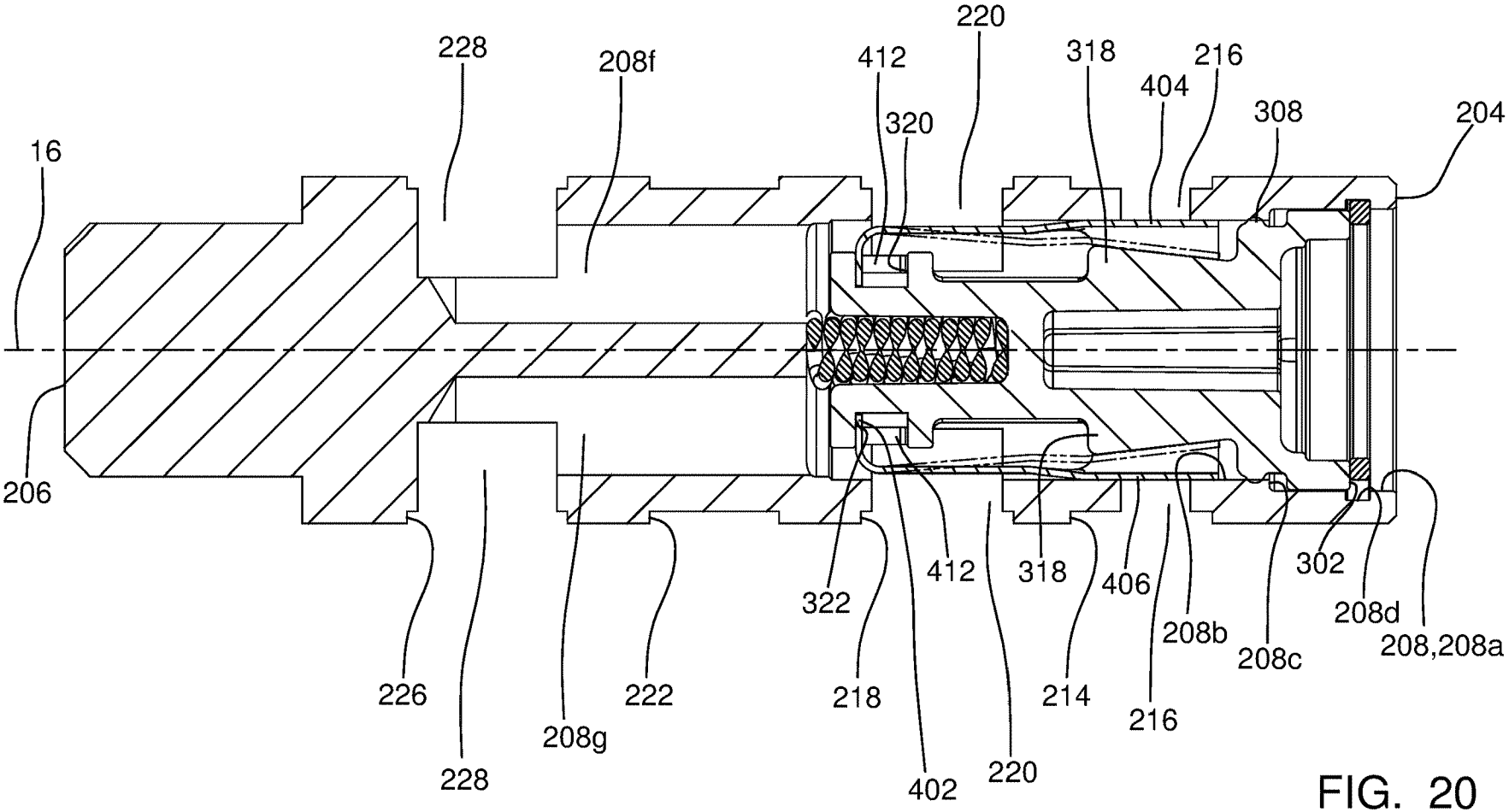
FIG. 20 is another axial cross-sectional view of the valve spool, the insert, and the check valve of FIG. 12 taken rotated 90° relative to the axial cross-sectional view of FIG. 19.

In order to fix check valve 400 in position on insert 300, check valve 400 includes a plurality of check valve retention members 412 extending from check valve base 402. As illustrated herein, four check valve retention members 412 may be provided such that first leg 402*a* includes two check valve retention members 412, one on each side of first arm 408, and such that second leg 402*b* includes two check valve retention members 412, one on each side of second arm 410, however, a lesser number or a greater number of check valve retention members 412 may be provided on check valve base 402. Check valve retention members 412 are open-ended loops which are resilient and compliant such that check valve retention members 412 are located within insert retention channel 324 and are held in compression against insert first surface 320, thereby compressing check valve base 402 against insert second surface 322 and retaining check valve 400 to insert 300. It should be noted that FIG. 20 illustrates first check valve member 404 and second check valve member 406 in solid lines in the seated position and also illustrates first check valve member 404 and second check valve member 406 in phantom lines in an unseated position which permits flow into valve spool bore 208 when a pressure differential causes first check valve member 404 and second check valve member 406 to resiliently flex first arm 408 and second arm 410 respectively. As shown in FIG. 20, travel of first check valve member 404 and second check valve member 406 is limited by insert check valve travel limiters 318.

Valve spool 200, insert 300, and check valve 400 as described herein allows for simplified construction of camshaft phaser 12 compared to the prior art and ensures that check valve 400 is supported by insert 300 while minimizing sliding contact between check valve 400 and insert 300, thereby minimizing wear. Additionally, inclusion of annular chamber 314 allows for a portion of insert sealing bead 308 to be sheared off which ensures sealing in the radial direction between insert sealing bead 308 and valve spool 200. Also additionally, including insert spring 332 ensures that insert 300 and check valve 400 remain static in the pulsed pressure environment within valve spool 200.

While valve spool 200, insert 300, and check valve 400 have been illustrated herein as being applied to an oil pressure actuated camshaft phaser, it should be understood that some features may be equally applicable to cam torque actuated camshaft phasers which utilize torque reversals of the camshaft to move oil directly from the advance chambers to the retard chambers or to move oil directly from the retard chambers to the advance chambers to change the phase relationship. One such cam torque actuated camshaft phaser is described in U.S. Pat. No. 9,587,526 to Lichti et al., the disclosure of which is incorporated herein by reference in its entirety.

While this invention has been described in terms of preferred embodiments thereof, it is not intended to be so limited, but rather only to the extent set forth in the claims that follow.

We claim:

1. A camshaft phaser for use with an internal combustion engine for controllably varying a phase relationship between a crankshaft and a camshaft in said internal combustion engine, said camshaft phaser comprising:

an input member connectable to said crankshaft of said internal combustion engine to provide a fixed ratio of rotation, about an axis of rotation, between said input member and said crankshaft;

an output member connectable to said camshaft of said internal combustion engine and defining an advance chamber and a retard chamber with said input member;

a valve spool moveable along said axis of rotation between an advance position and a retard position and having a valve spool bore extending into said valve spool along said axis of rotation, wherein said advance position allows oil to be vented from said advance chamber and to be supplied to said retard chamber from said valve spool bore in order to advance timing of said camshaft relative to said crankshaft and wherein said retard position allows oil to be vented from said retard chamber and to be supplied to said advance chamber from said valve spool bore in order to retard the timing of said camshaft relative to said crankshaft;

a check valve within said valve spool bore, said check valve including a check valve member which moves between a seated position and an unseated position such that said check valve member prevents fluid flow out of said valve spool bore through a passage and such that said check valve member permits flow into said valve spool bore through said passage;

an insert within said valve spool bore such that said insert supports said check valve within said valve spool bore and sealingly closes one end of said valve spool bore;

an insert retainer with which said insert is abutted and retains said insert within said valve spool bore; and an insert spring which urges said insert toward said insert retainer and holds said insert in compression against said insert retainer.

2. The camshaft phaser as in claim 1, wherein said insert includes an insert spring bore extending into said insert such that said insert spring is located partially within said insert spring bore.

3. The camshaft phaser as in claim 2, wherein said insert spring bore extends into said insert in a direction parallel to said axis of rotation.

4. The camshaft phaser as in claim 3, wherein said insert spring bore is centered about, and extends along, an insert spring bore axis which is parallel to, and laterally offset from, said axis of rotation.

5. The camshaft phaser as in claim 2, wherein:

said insert spring bore includes an insert spring bore end wall;

said valve spool bore includes a valve spool bore floor which is traverse to said axis of rotation; and said insert spring engages said insert spring bore end wall and said valve spool bore floor such that said insert spring is held in compression between said insert spring bore end wall and said valve spool bore floor.

6. The camshaft phaser as in claim 5, wherein:

said valve spool includes a valve spool bore insert clocking bore extending from said valve spool bore floor; and said insert includes an insert alignment pin extending into said valve spool bore insert clocking bore which prevents rotation of said insert within said valve spool bore about said axis of rotation.

7. The camshaft phaser as in claim 6, wherein said insert alignment pin is eccentric to said axis of rotation.

8. The camshaft phaser as in claim 1, wherein:

said insert includes an insert first surface which is traverse to said axis of rotation and an insert second surface which is traverse to said axis of rotation and spaced axially apart from said insert first surface, thereby defining an insert retention channel axially between said insert first surface and said insert second surface;

said check valve includes a check valve retention member which is held in compression within said insert retention channel by said insert first surface and said insert second surface.

9. The camshaft phaser as in claim 1, wherein:

said check valve member is a first check valve member;

said passage is a first passage; and said check valve includes a second check valve member which moves between a seated position and an unseated position such that said second check valve member prevents fluid flow out of said valve spool bore through a second passage and such that said second check valve member permits flow into said valve spool bore through said second passage.

10. The camshaft phaser as in claim 9, wherein said first check valve member and said second check valve member are diametrically opposed to each other.

11. The camshaft phaser as in claim 9, wherein said:

said check valve includes a check valve base which includes a first leg, a second leg laterally spaced from said first leg, and a bridge which joins one end of said first leg to one end of said second leg;

said first check valve member is connected to said first leg by a first arm which is resilient and compliant, thereby biasing said first check valve member into said seated position of said first check valve member; and said second check valve member is connected to said second leg by a second arm which is resilient and compliant, thereby biasing said second check valve member into said seated position of said second check valve member.

12. The camshaft phaser as in claim 11, wherein:

said insert includes an insert first surface which is traverse to said axis of rotation and an insert second surface which is traverse to said axis of rotation and spaced axially apart from said insert first surface, thereby defining an insert retention channel axially between said insert first surface and said insert second surface;

said check valve base is located within said insert retention channel and includes a check valve retention member held in compression against said insert first surface which holds said check valve base in compression against said insert second surface.

13. The camshaft phaser as in claim 12, wherein said check valve retention member is one of a plurality of check valve retention members which are each held in compression against said insert first surface and which hold said check valve base in compression against said insert second surface.

14. The camshaft phaser as in claim 13, wherein a first two of said plurality of check valve retention members extend from said first leg and a second two of said plurality of check valve retention members extend from said second leg.

15. The camshaft phaser as in claim 14, wherein:

said first arm extends from said first leg at a location between said first two of said plurality of check valve retention members; and said second arm extends from said second leg at a location between said second two of said plurality of check valve retention members.

16. The camshaft phaser as in claim 1, wherein:

said valve spool bore includes a valve spool bore first portion and a valve spool bore second portion which is smaller in diameter than said valve spool bore first portion;

said valve spool bore first portion includes a valve spool bore retention groove that extends radially outward therefrom;

said insert retainer is a retaining ring which is located within said valve spool bore retention groove and extends radially inward from said valve spool bore first portion.

17. The camshaft phaser as in claim 16, wherein:

said insert includes an insert first portion which is located within said valve spool bore first portion;

said insert includes an insert sealing bead which is located within said valve spool bore second portion;

said insert includes an insert groove which is located axially between said insert first portion and said insert sealing bead; and an annular chamber is formed radially between said insert groove and said valve spool bore which captures debris caused by insertion of said insert sealing bead into said valve spool bore.

18. The camshaft phaser as in claim 17, wherein said annular chamber is formed radially between said insert groove and said valve spool bore first portion and also radially between said insert groove and said valve spool bore second portion.

19. The camshaft phaser as in claim 1, wherein:

said valve spool bore includes a valve spool bore first portion and a valve spool bore second portion which is smaller in diameter than said valve spool bore first portion;

said valve spool bore first portion includes a valve spool bore retention groove that extends radially outward therefrom;

said insert includes an insert first portion which is located within said valve spool bore first portion;

said insert includes an insert sealing bead which is located within said valve spool bore second portion;

said insert includes an insert groove which is located axially between said insert first portion and said insert sealing bead; and an annular chamber is formed radially between said insert groove and said valve spool bore which captures debris caused by insertion of said insert sealing bead into said valve spool bore.

20. The camshaft phaser as in claim 19, wherein said annular chamber is formed radially between said insert groove and said valve spool bore first portion and also radially between said insert groove and said valve spool bore second portion.

* * * * *